US006802160B2

(12) United States Patent
Harambasic et al.

(10) Patent No.: US 6,802,160 B2
(45) Date of Patent: Oct. 12, 2004

(54) BUILDING STRUCTURE UTILIZING MODULAR BUILDING ELEMENTS

(76) Inventors: Dzevad Harambasic, 2/25 The Crescent, Berala. NSW 2141 (AU); Bahra Harambasic, 2/25 The Crescent, Berala, NSW 2141 (AU)

( * ) Notice: Subject to any disclaimer, the term of this patent is extended or adjusted under 35 U.S.C. 154(b) by 0 days.

(21) Appl. No.: 10/148,531

(22) PCT Filed: Nov. 29, 2000

(86) PCT No.: PCT/AU00/01474

§ 371 (c)(1),
(2), (4) Date: May 29, 2002

(87) PCT Pub. No.: WO01/40592

PCT Pub. Date: Jun. 7, 2001

(65) Prior Publication Data

US 2002/0178669 A1 Dec. 5, 2002

(30) Foreign Application Priority Data

Nov. 29, 1999 (AU) ..... 61764/99

(51) Int. Cl.[7] ..... E04H 1/00; A63H 33/08

(52) U.S. Cl. ..... 52/264; 52/236.7; 52/236.9; 52/266; 52/271; 52/274; 52/293.2; 52/592.6; 446/85; 446/124; 446/476

(58) Field of Search ..... 52/236.6, 236.7, 52/236.8, 236.9, 252, 262, 264, 266, 271, 274, 286, 293.2, 294, 591.1, 590.2, 592.1, 592.6, 745.1; 446/476, 85, 105, 124

(56) References Cited

U.S. PATENT DOCUMENTS 963,368 A * 7/1910 Hall ..... 52/300
1,206,484 A * 11/1916 Swan ..... 52/223.3
1,618,696 A * 2/1927 Bemis ..... 52/220.2
2,336,435 A * 12/1943 Zirinsky ..... 52/236.7
3,372,519 A * 3/1968 Russell ..... 52/274
3,566,558 A * 3/1971 Fisher ..... 52/73
3,656,577 A * 4/1972 Larsson et al. ..... 181/285
3,902,291 A * 9/1975 Zucht ..... 52/284
3,950,902 A 4/1976 Stout (List continued on next page.)

FOREIGN PATENT DOCUMENTS

| | | |
|---|---|---|
| GB | 2221705 | 8/1989 |
| GB | 2252056 | 1/1991 |
| SU | 560033 | 6/1977 |

*Primary Examiner*—Brian E. Glessner
(74) *Attorney, Agent, or Firm*—Barbara A. Wrigley; Oppenheimer Wolff & Donnelly LLP

(57) ABSTRACT

A building structure formed from modular building elements, which include first modular building elements (1,9) having socket beam interconnection means (2), second modular building elements (13,14,15) and socket beams (7, 11) having first modular building element interconnection means (6); whereby a socket beam (7,11) forms an interconnection with at least one first modular building element (1,9) and at least one second modular building element (13, 14, 15) associates with a socket beam (7,11) and first modular building element interconnection, a socket beam (7,11) and at least one first modular building element (1,9) and at least one second modular building element (13,14,15) forming a configuration unit, the configuration unit being repeatable one atop the other, and being repeatable in a side-by-side fashion, a first modular building element associating or abutting with adjacent first modular building elements, a second modular building elements associating or abutting with adjacent second modular building elements and a socket beam associating or abutting with adjacent socket beams.

26 Claims, 20 Drawing Sheets

U.S. PATENT DOCUMENTS 4,018,021 A * 4/1977 Dow ..... 52/251
4,270,304 A * 6/1981 Sofer ..... 446/106
4,328,651 A * 5/1982 Gutierrez ..... 52/293.1
4,461,130 A * 7/1984 Shubow ..... 52/236.8
4,616,459 A * 10/1986 Shubow ..... 52/309.12
4,709,640 A * 12/1987 Jouanin ..... 108/91
5,072,554 A 12/1991 Hayman
5,680,735 A * 10/1997 Bates ..... 52/591.5

* cited by examiner

BUILDING STRUCTURE UTILIZING MODULAR BUILDING ELEMENTS

TECHNICAL FIELD

The present invention relates to a new type of building structure, and in particular, to a building structure which is constructed from discrete modular building elements thereby facilitating a variety of configurations or designs of building structure.

BACKGROUND ART

Currently, many building structures are constructed using a large number of small individual components. This practice requires significant time, effort and skill to bring to completion even a comparatively minor building structure such as a house. In attempting to overcome this and other drawbacks, building structures utilising modular building components have been devised and are known. However, many of these prefabricated or modular components have simply transferred the time, effort and skill from the building location to a factory location. Transporting prefabricated or modular components from a factory location to a building location results in an additional cost to the overall expense of erecting the building structure, which may only prove commercially viable for kit homes.

Furthermore, simply transferring the manufacture or construction of prefabricated or modular components to a building site may significantly reduce the cost of building structures below that which is incurred by manufacturing prefabricated or modular components in a factory. However, the components must be capable of being satisfactorily manufactured at the building site where limited facilities are available.

Many various types of building structures utilising modular components or elements have been proposed. Due to the complexity and variation associated with constructing a building structure none of these previous systems overcome all of the problems associated with erecting a building structure.

For example, U.S. Pat. No. 3950902 discloses a concrete structure constructed from a single basic, monolithic precast modular concrete beam. Each beam is an elongated concrete member having a generally rectangular cross-section, and having a central aperture extending through the length of said beam. However, these concrete structures are limited to relatively small buildings, for example houses, where a relatively high structural integrity is not required. Hence, the modular concrete beam may be comparatively small in dimensions.

U.S. Pat. No. 5072554 discloses a prefabricated modular building structure which is constructed of a plurality of panels. Vertical panels are interlocked by sliding a built in flange on each panel into a built in channel member on an adjacent panel. The specification is directed towards a single layer of vertical panels only, and foundations are not utilised due to the modular storage building being of a relatively small size. Therefore, this invention is still limited in its scope of overcoming the problems associated with modular building structures.

The problems associated with providing a flexible and stable modular building structure are complex, this is attested to by the fact that although a significant effort has been made to solve the problems, the modular or prefabricated building industries have only captured and extremely small percentage of the housing market, perhaps as little as 8%, after many decades. The complexities present can impose a height restriction on many forms of modular building structures.

This identifies a need for an improved type of modular building structure which overcomes the problems inherent in the prior art The present invention seeks to provide an improved modular building structure which includes only a limited number of basic modular elements which can be used for foundations, walls, floors, ceilings, etc., that can be mass produced on-site or at a factory if desired, but does not require the construction of specialised or expensive factories.

Furthermore the present invention seeks to provide, inter alia: modular elements which can be used to construct a wide variety of plans or designs of building structures and meet a wide range of structural requirements; which may also be reinforced to resist any dynamic force; that his fire proof, rock proof and vermin proof; that can be produced from a few locally available materials; that can be lifted and handled by available inexpensive mobile machinery; and may be put together in a simple manner, which may utilise relatively unskilled labour.

Accordingly, the present invention seeks to provide these and other features providing an improved and flexible building structure which is constructed from discrete modular building elements.

It should be noted that in this specification reference to the term 'building structure' is a reference to a real and effective building structure, that is a full-scale building structure. The term 'building structure' is not intended to include within its scope a toy, miniature or model building.

DISCLOSURE OF INVENTION

The present invention according to one aspect seeks to provide a building structure formed from modular building elements, wherein the building structure includes:

first modular building elements provided with protrusions for interconnection with at least one socket beam; and second modular building elements; and socket beams provided with at least two holes, slots or recesses for receiving protrusions from first modular building elements, the holes, slots or recesses located near or at the mid-section of a surface of a socket beam; and whereby a socket beam forms an interconnection with at least two first modular building elements, the first modular building elements being held laterally abutted to each other as a result of the mutual interconnection of respective protrusions with holes, slots or recesses of the socket beam, and, at least one second modular building element associates with the socket beam and first modular building element interconnection; such that, a socket beam and at least two first modular building elements and at least one second modular building element form a configuration unit, the configuration unit able to engage or abut other adjacent configuration units in a side by side fashion such that the second modular building elements define a substantially planar surface, and whereby first modular building elements abut adjacent first modular building elements, second modular building elements abut adjacent second modular building elements and a socket beam abuts adjacent socket beams.

In another preferred form of the invention it is sought to provide a building structure wherein a second modular building element has at least one edge supported by a portion of the socket beam with which it associates. In a particular embodiment the configuration unit is able to engage or abut other adjacent configuration units in a one atop the other fashion to provide a multi-storey building structure. The present invention according to another aspect seeks to provide a foundation structure is provided and at least one of the components of the building structure associates with the foundation structure. The present invention according to yet another aspect seeks to provide a foundation support socket beam associates with the foundation structure, the foundation support socket beam able to interconnect with a foundation first modular building element, and at least one socket beam able to interconnect with the foundation first modular building element. There is also sought to be provided a foundation second modular building element associates with the foundation structure, the foundation second modular building element able to receive at least one first modular building element.

In a preferred form, a first modular building element is a wall panel, and a second modular building element is a floor panel or a ceiling panel. Also preferably, the socket beam has a substantially flat upper surface, part of which assists to support the second modular building elements, and a lower surface provided with a central recess, in addition to the at least two holes, slots or recesses for receiving protrusions from first modular building elements, into which part of a lower first modular building element can be inserted. In a further preferred form, at least one edge of a first modular building element has off-centre protrusions, and an adjacent first modular building element also has off-centre protrusions so that when the first modular building elements are side-by-side the abutting off-centre protrusions form a combined protrusion, and at least one side of a socket beam has a hole, slot or recess to receive said combined protrusion of the first modular building elements.

According to another aspect of the present invention at least one edge of a second modular building element has a protrusion or protrusions whereby an angled joint is formed by the protrusion of the second modular building element and a protrusion of a first modular building element, and the protrusion of the second: modular building element sits intermediate the first modular building element and the socket beam. Also, the angle of the angular joint may be substantially perpendicular. Furthermore, the edges of the protrusion or protrusions may be angled, bevelled, sloped or inclined. Still furthermore, the internal edges of the socket beam holes, slots or recesses may be angled, bevelled, sloped or inclined. In a specific aspect of the present invention at least one of the modular building elements is a corner modular building element whereby the corner modular building element is a L-type, T-type or X-type geometry.

In a broad form, any of the first modular building elements or socket beams can be a substantially curved element. Furthermore, one edge of the first or second modular building elements may be provided with a flange, and another edge may be provided with a channel or recess. Also, the flange of one first or second modular building element may associate with the channel or recess of an adjacent first or second modular building element respectively.

According to a further aspect both edges of the first or second modular building elements may be provided with channels or recesses, whereby the periphery region of the channel or recess of a first or second modular building element abuts the periphery region of the channel or recess of an adjacent first or second modular building element respectively.

In a further embodiment of the present invention exterior modular building elements are affixed to selected socket beams, first modular building elements and/or second modular building elements. Gaps between first modular building elements, second modular building elements and/or socket beams can be filled with a filling substance. In one form, the first modular building elements, second modular building elements, socket beams and other similar elements are manufactured from concrete, reinforced concrete or super light concrete.

In a specific embodiment the interconnection or association means may include longitudinal halving, bevelled halving, tee halving, dovetailed halving, angle halving, dovetailed cross-halving, notching, butting, a rebated joint, a tongued joint, a housed joint, a dovetailed trenched joint, a finger joint, an angle finger joint, an angle dovetail joint, a lapped dovetailed joint, a bridle joint or any similar such joint or means of interconnection or association. According to a further broad form, the building structure is frameless, and the building structure is capable of being modified, dismounted, disjoined or the like.

In a further embodiment of the present invention there is sought to be provided a toy structure formed from toy building elements, wherein the toy structure includes:

first modular toy elements provided with protrusions for interconnection with at least one toy socket beam; and second modular toy elements; and toy socket beams provided with at least two holes, slots or recesses for receiving protrusions from first modular toy elements, the holes, slots or recesses located near or at the mid-section of a surface of a toy socket beam, the toy socket beams not having the same geometry as the first modular toy elements or the second modular toy elements; and whereby a toy socket beam forms an interconnection with at least two first modular toy elements, the first modular toy elements being held laterally abutted to each other as a result of the mutual interconnection of respective protrusions with holes, slots or recesses of the toy socket beam, and, at least one second modular toy element associates with the toy socket beam and first modular toy element interconnection; such that, p1 a toy socket beam and at least two first modular toy elements and at least one second modular toy element form a toy configuration unit, the toy configuration unit able to engage or abut other adjacent toy configuration units in a side by side fashion such that the second modular toy elements define a substantially planar surface, and whereby first modular toy elements abut adjacent first modular toy elements, second modular toy elements abut adjacent second modular toy elements and a toy socket beam abuts adjacent toy socket beams.

The modular toy elements may be used as children's play building blocks and could be manufactured from plastic, a synthetic polymeric substance, wood, or metal. Additionally, the toy structure may be a miniature building set for the making of scale models.

In a still further broad form of the present invention, there is'sought to be provided a system of erecting a building structure including the steps of:

forming a building structure foundation structure; and using the building structure foundation to support a first layer of socket beams positioned at the desired locations; and using the first layer of socket beams to support a first level of first modular building elements having socket beam interconnection means; and using the first layer of socket beams to vertically support a first level of second modular building elements; and using the interconnection means of the first layer of socket beams and the first level of first modular building elements to laterally hold the first level of second modular building elements; and whereby a socket beam and at least two first modular building elements and at least one second modular building element form a configuration unit, the configuration unit being repeatable one atop the other, and being repeatable in a side-by-side fashion, and whereby first modular building elements abut adjacent first modular building elements, second modular building elements abut adjacent second modular building elements and a socket beam abuts adjacent socket beams.

In a still further broad form of the present invention, there is sought to be provided a system of erecting a building structure including the steps of.

forming a building structure foundation structure; and using the building structure foundation, to support a first layer of socket beams positioned at the desired locations; and using the first layer of socket beams to support a first level of wall panels having socket beam interconnection means; and using the first layer of socket beams to vertically support a first level of floor panels; and using the interconnection means of the first layer of socket beams and the first level of wall panels to laterally hold the first level of floor panels; and whereby a socket beam and at least two first modular building elements and at least one second modular building element form a configuration unit, the configuration unit being repeatable one atop the other, and being repeatable in a side-by-side fashion, and whereby first modular building elements abut adjacent first modular building elements, second modular building elements abut adjacent second modular building elements and a socket beam abuts adjacent socket beams.

It may also be provided that the first modular building elements, second modular building elements, socket beams and other similar elements are manufactured on-site at the location of the building structure.

In another broad form of the invention there is provided a building structure, substantially according to the embodiment described in the specification with reference to and as illustrated in the accompanying figures.

In another broad form of the invention there is provided a toy structure, substantially according to the embodiment described in the specification with reference to and as illustrated in the accompanying figures.

In another broad form of the invention there is provided a system of erecting a building structure, substantially according to the embodiment described in the specification with reference to the accompanying figures.

BRIEF DESCRIPTION OF FIGURES

The present invention will become more easily understood from the following detailed description of a preferred but non-limiting embodiment thereof, described in connection with the accompanying figures, wherein:

FIG. 1(*b*) illustrates a preferred embodiment of the present invention wherein, the figure shows an isometric views of a configuration unit.

FIG. 1(*c*) illustrates an embodiment of the present invention wherein, the figure shows configuration units with cut-out regions to show the nature of the interconnections.

FIG. 3(*b*) illustrates a preferred embodiment of the present invention wherein, the figure shows an isometric view of disjoined modular building elements having a foundation ground floor panel variation.

FIG. 4(*b*) illustrates a preferred embodiment of the present invention wherein, the figure shows an isometric view of a selection of floor panels, the floor panels shown having indeterminate length.

FIG. 4(*c*) illustrates a preferred embodiment of the present invention wherein, the figure shows an isometric view of a selection of floor panels, the floor panels shown having indeterminate length.

FIG. 4(*d*) illustrates a preferred embodiment of the present invention wherein, the figure shows an isometric view of a selection of wall panels.

FIG. 6(*a*) illustrates a preferred embodiment of the present invention wherein, the figure shows an isometric view of a selection of wall panel corner types.

FIG. 9(*a*) illustrates a preferred embodiment of the present invention wherein, the figure shows an isometric view of a selection of socket beam variations.

MODES FOR CARRYING OUT THE INVENTION

Figure 1:
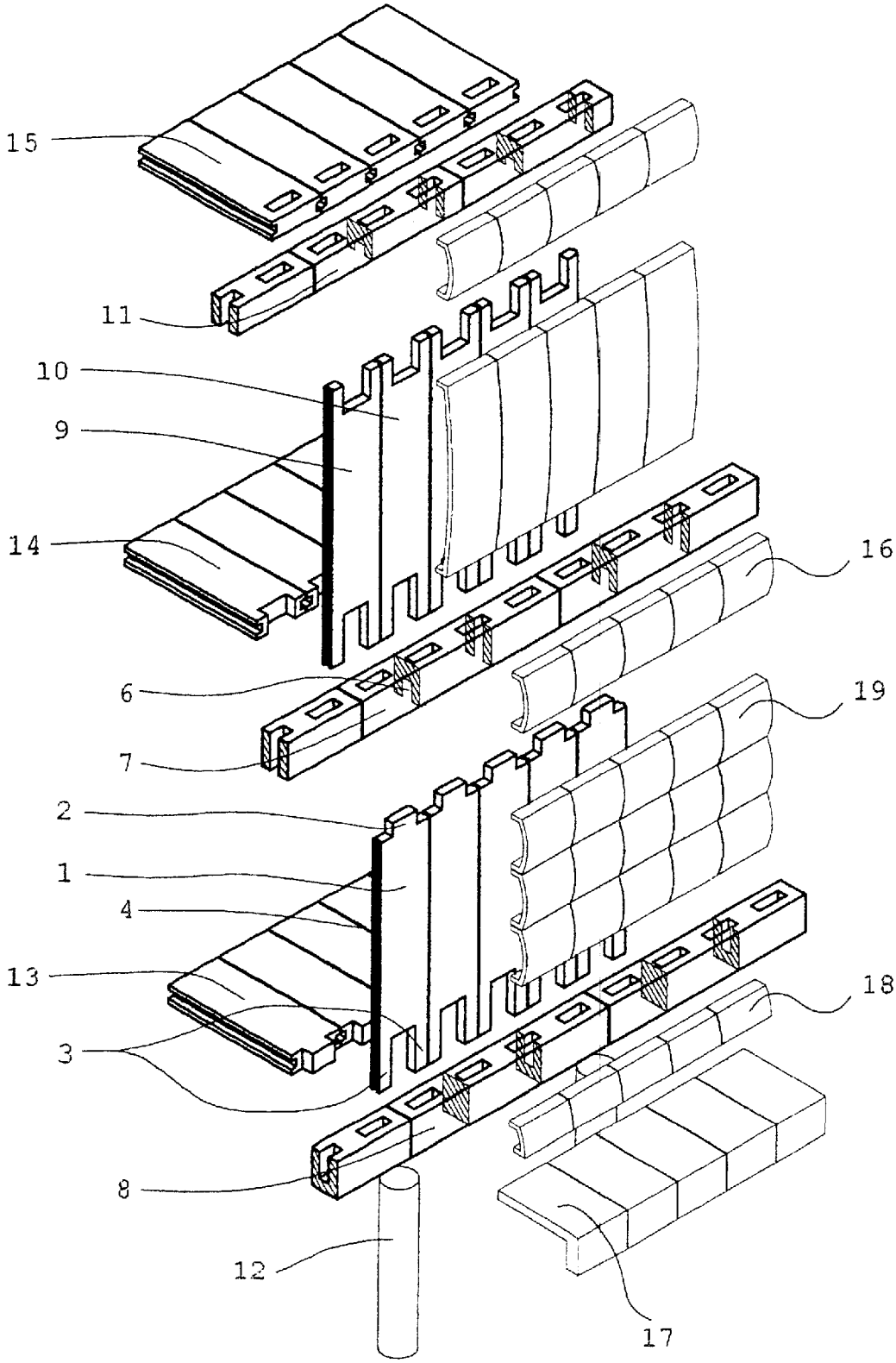
FIG. 1(*a*) illustrates a preferred embodiment of the present invention wherein, the figure shows an isometric view of disjoined modular building elements.
Figure 1:
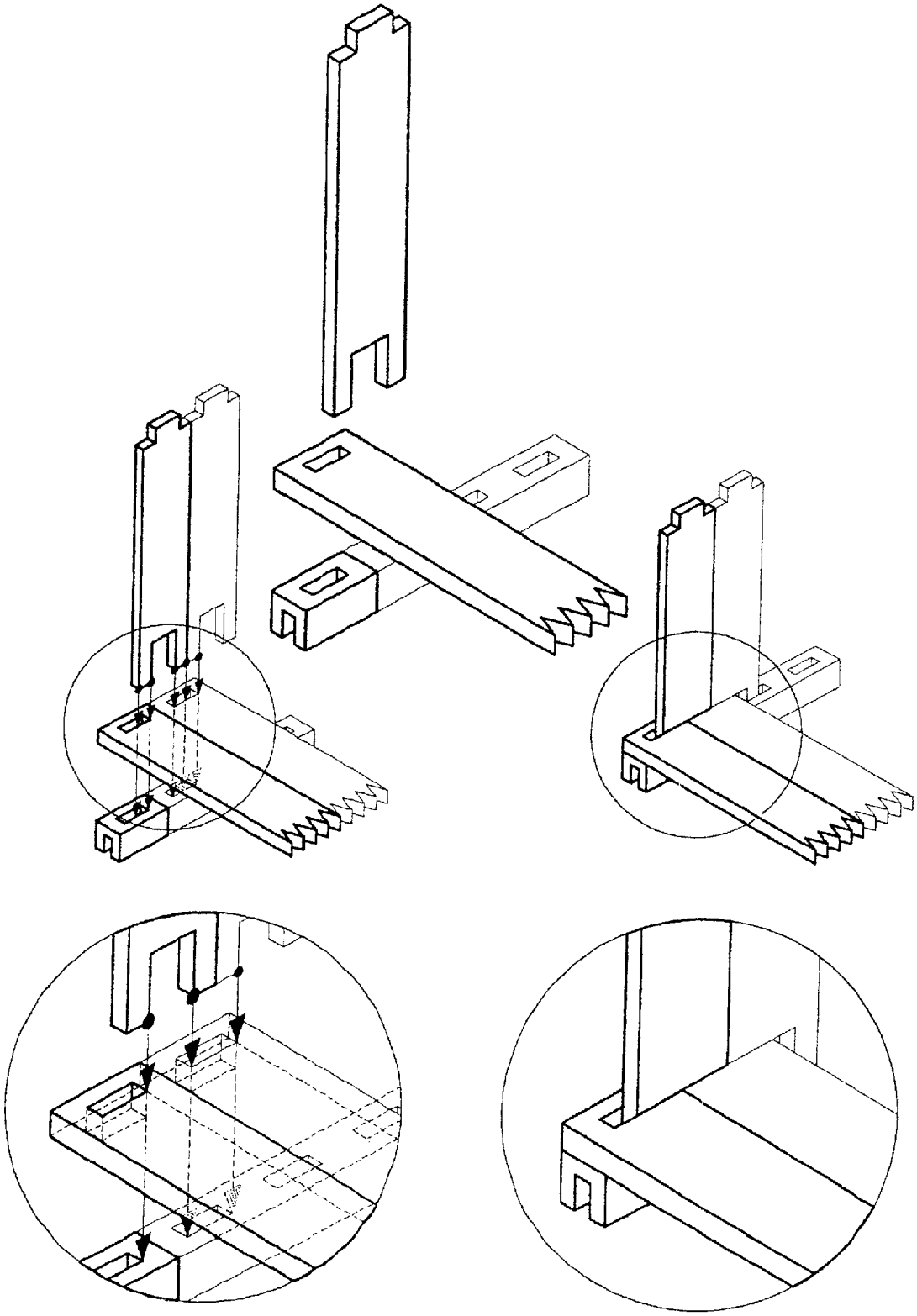
Figure 1:
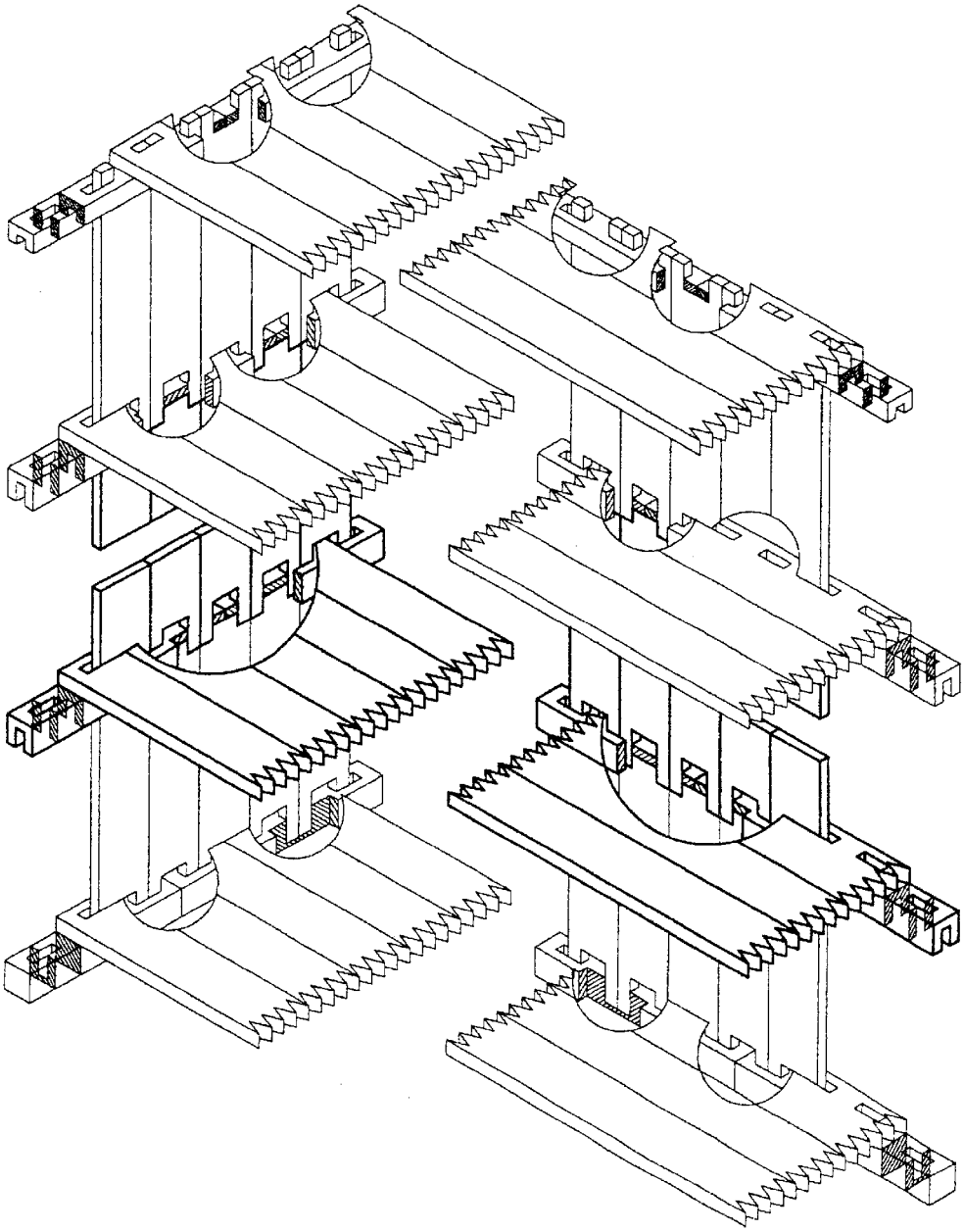

The present invention provides an improved building structure using modular building elements. In the figures, incorporated to illustrate the features of the present invention, like reference numerals are used to identify like parts throughout the figures.

Figure 4:
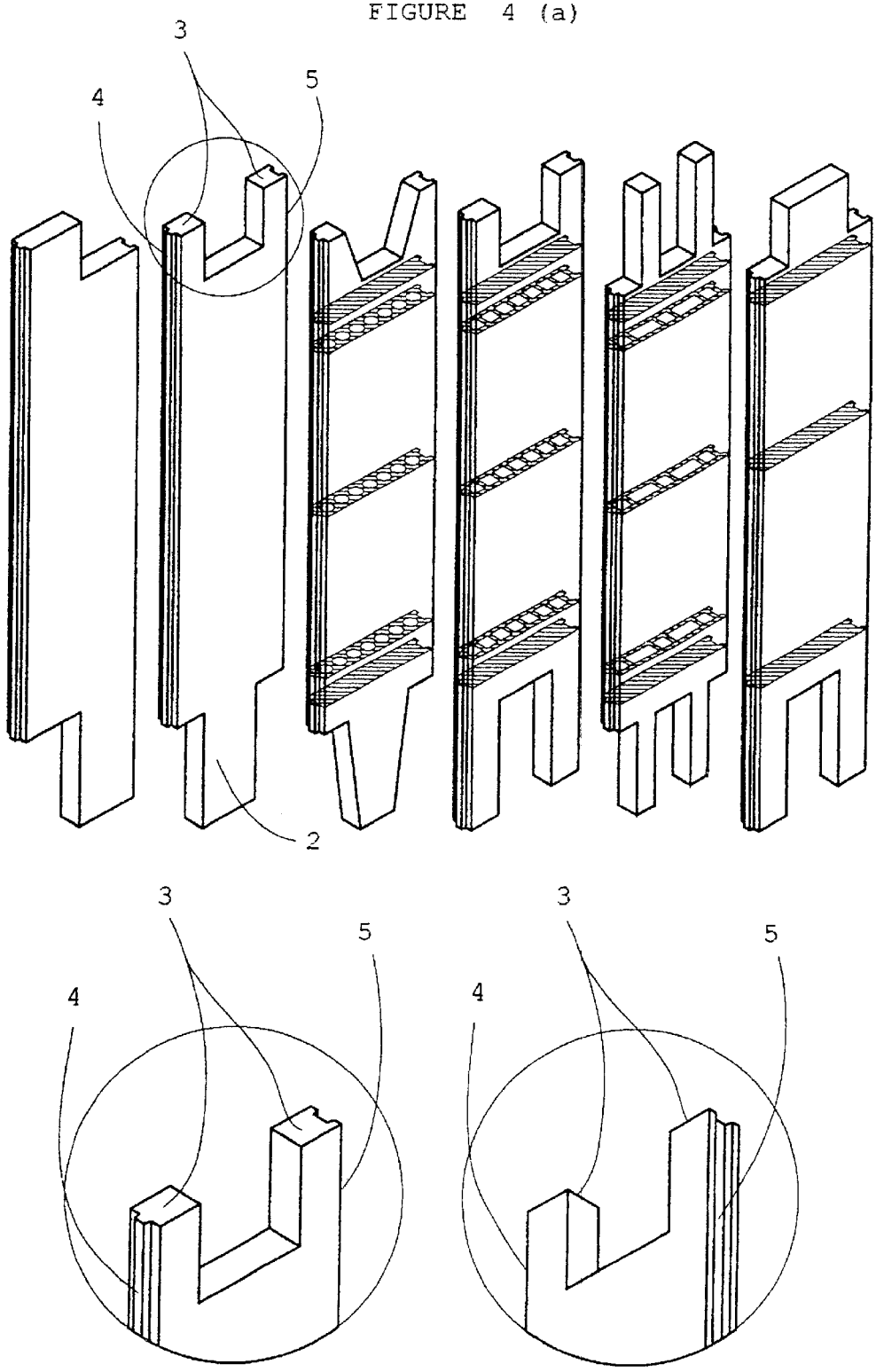
FIG. 4(*a*) illustrates a preferred embodiment of the present invention wherein, the figure shows an isometric view of a selection of wall panels.
Figure 4:
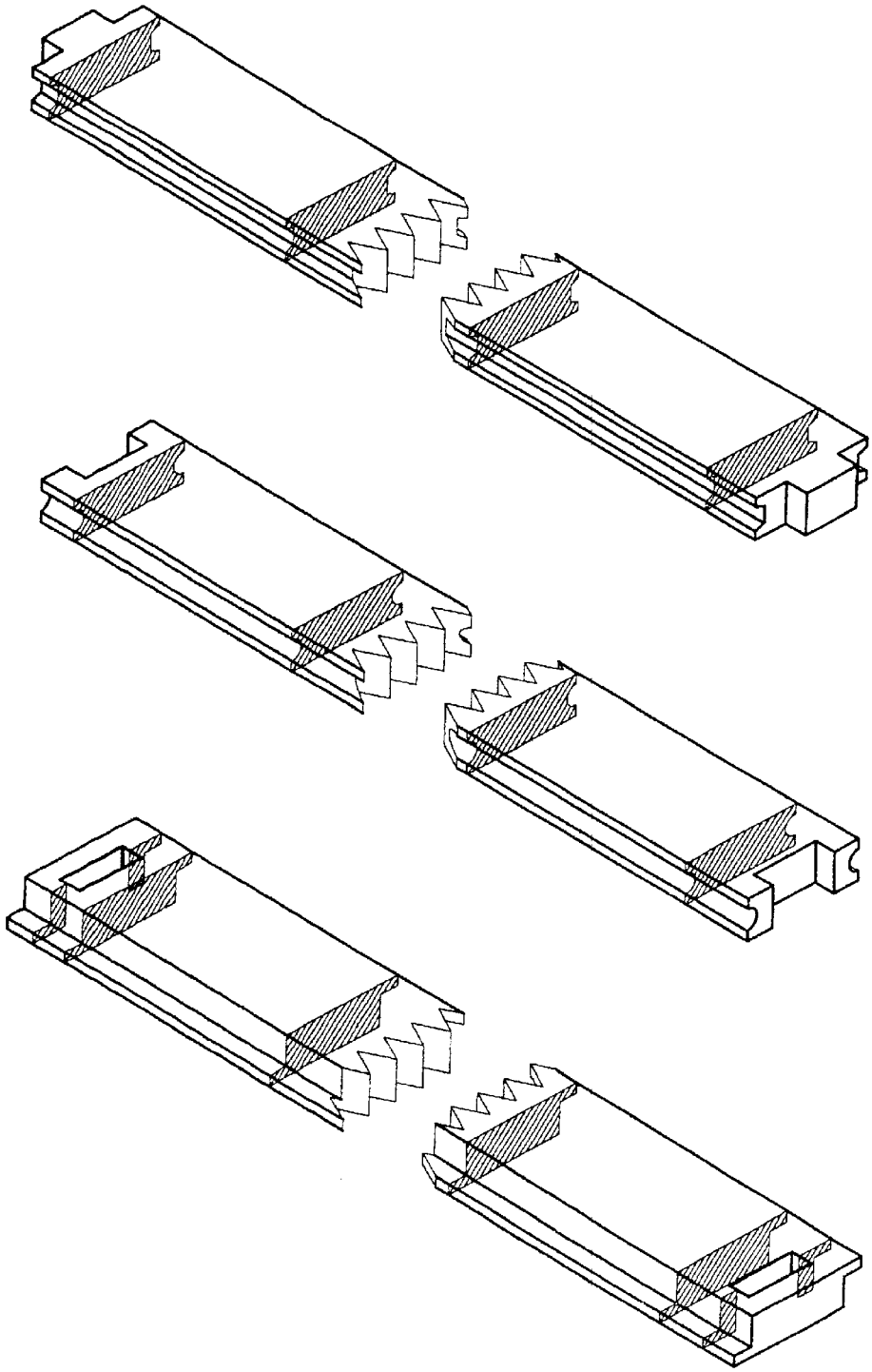
Figure 4:
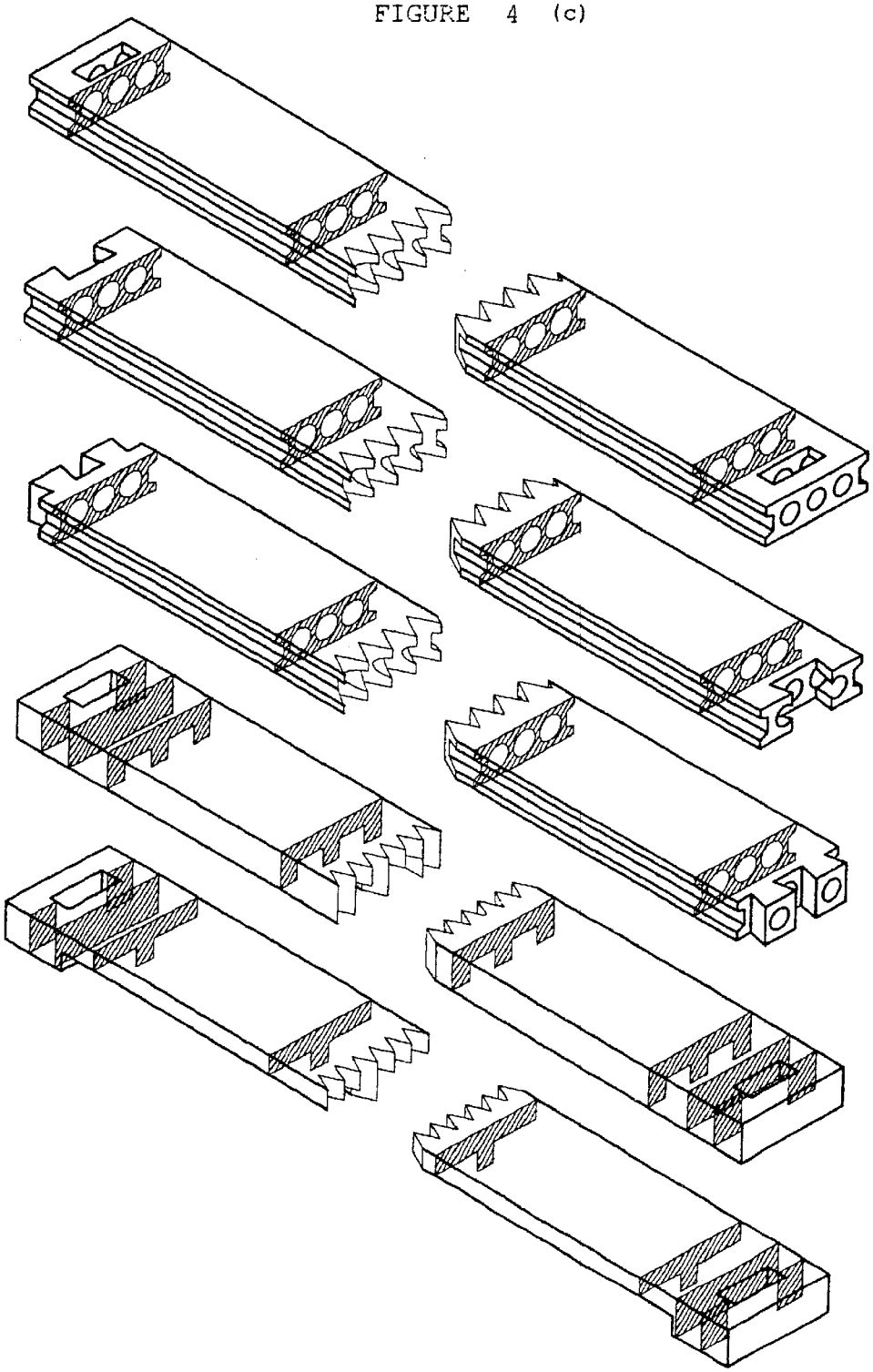
Figure 4:
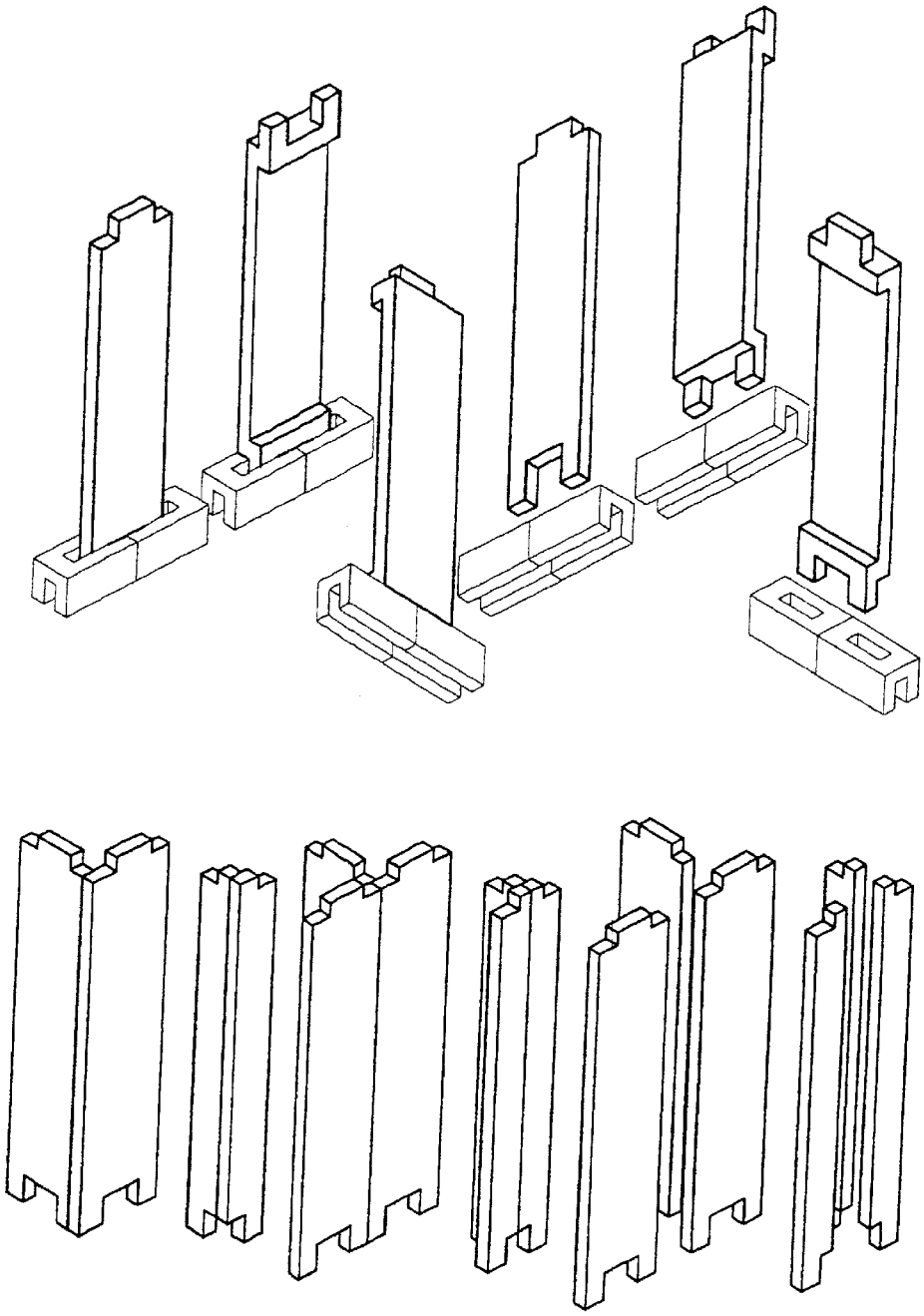

A preferred, but non-limiting, embodiment of the present invention is shown in FIG. 1(*a*). In this figure is shown an isometric view of various disjoined modular building elements which when associated with each other form part of a building structure. In this non-limiting example first modular building elements are represented as wall panels of various types. Furthermore, second modular building elements are represented as floor panels of various types. Shown in this figure is a wall panel 1, the wall panel 1 contains a centred protrusion 2 at one end and further off-centre protrusions 3 at the opposite end. Disposed along one edge of the wall panel 1 is a flange member 4 and disposed along the opposite edge to the flange member 4 is a built in channel member 5, as shown in FIG. 4(*a*). When in position adjacent wall panels associate such that the flange member of a first wall panel abuts the built in channel member of an adjacent wall panel. However, wall panels may be provided without flange or channel members so that they sit flush against adjacent wall panels.

The centred protrusion 2 of the wall panel 1 is received by a slot 6 in a socket beam 7. The socket beam 7, as shown in the figure, is able to receive separate wall panels similar to wall panel 1. As shown in the figure, the separate wall panels are associated by their respective flange members and built in channel members. The centred protrusion of a wall panel 1 may extend fully through the length of the slot 6 in the socket beam 7, or only partially. The configuration of the socket beam 7 is such that it is substantially planer on the side of the socket beam from which a wall panel 1 enters the slots of the socket beam, furthermore, the socket beam is substantially planer on the side opposite thereto. The off-centre protrusions 3 located at the opposite end to the centred protrusion 2 of the wall panel 1 associate with the off-centre protrusions of adjacent wall panels of a type similar to wall panel 1 such that the combination of the off-centre protrusions is of a dimension which may be received by a socket beam, in this example, socket beam 8. Furthermore, a wall panel protrusion may fully extend through the slot of a socket beam and make contact with a wall panel in a lower or higher position in the building structure, this may provide further stability to the building structure.

Wall panel 9 shows a variation in the geometry of a wall panel. In this geometry of a wall panel the protrusions at both ends of the wall panel 9 are located at the edges of the wall panel, that is, both ends of the wall panel 9 contain off-centre protrusions. As before, these off-centre protrusions associate with the off-centre protrusions of adjacent wall panels similar to the wall panel 2 such that the combination of adjacent off-centre protrusions is of a dimension which may be received by a socket beam. The off-centre protrusions at either end of the wall panel 9 need not be similar in length or in width. In the figure, the associated off-centre protrusions of adjacent wall panels 9 and 10 associate with the socket beam 7 at one end, and with the socket beam 11 at the other end, the socket beams 7 and 11 may, or may not, be of the same type.

A variety of socket beams are shown in the figure, for example, the socket beam 7, the socket beam 8 and the socket beam 11. In considering the scope of the invention the specific configuration or geometry of the socket beams should be disregarded. The variations in the configuration of the socket beams depend upon the type of modular building elements with which the socket beams associate. The socket beam 11 is constructed to have a flat base and flat ends so that it may be readily used in association with pier type foundations 12. However, this does not prevent other various types of socket beams from being interchanged within a building structure.

Additionally, the upper off-centre protrusions of a wall panel may receive the lower centred protrusions of subsequent higher wall panels, the centred protrusion extending through a socket beam slot.

Second modular building elements are represented as floor panels. It should be noted that in the present invention second modular building elements and first modular building elements may in some situations be identical except that they have been used in a configuration that is substantially perpendicular to each other, that is, they may be the same modular building element.

Floor panel building elements may be provided with either a centred protrusion, for example the floor panel 13, or with off-centre protrusions, for example the floor panel 14. Floor panels may be distinct elements to wall panels, or identical to such. As is shown in the figure, floor panels may associate with adjacent floor panels by utilising a flange member on one side of a floor panel which abuts a built in channel member on an adjacent floor panel, similar to the case for wall panels. As is indicated in the figure, a variety of configurations of floor panels may be used, for example, the floor panel 15 does not contain protrusions at either end. When assembling, the modular elements the floor panels with protrusions are positioned so that their respective protrusions fit into an intermittent space created by a wall panel and a socket beam. Hence, a component of the weight of a floor panel is supported by a socket beam, in addition, lateral movement of a floor panel is limited by a protrusion of a floor panel being disposed between a protrusion or protrusions of a wall panel. In the case where a floor panel of the type similar to floor panel 15 is used no protrusions from the floor panel are present, and the floor panel merely sits above the relevant socket beam. Floor panels may equally be, described as ceiling panels, a single second modular building element may form both a floor panel and a ceiling panel of a lower level, or separate second modular building elements may be used to individually provide distinct floor panels and ceiling panels.

In an alternative embodiment, the side edges of floor panels may abut each other whereby the abutting edges are both built in channel members of the adjacent floor panels. Hence, an extended orifice will be created along the length of the interface between the adjacent floor panels. Furthermore, floor panels need not have any lateral side channels, recesses, flanges or the like, but may merely be substantially planer and sit flush against adjacent floor panels. Furthermore, the interface between adjacent floor panels may utilise an angled planer edge or any other type of association or join.

Indeed, the preceding paragraph equally applies to wall panels. That is, many types of association or join may be used according to the effect which is desired to be obtained. For example, it may be chosen to cause abutting edges of adjacent wall panels to both have built in channel members so that the resulting orifice extending along the length of the wall panels may be used to house various pipes or cables, for example, water pipes and/or electrical cables. Additionally, the vacant region resulting from this type of arrangement of adjacent wall panels may be used to house a variety of other components, such as insulation or other devices.

Also shown in FIG. 1(*a*) are exterior panels, for example, the facade panel 16 provides an exterior surface to a socket beam. However, it should be realised that the exterior panels are optional. Also shown in the figure is an exterior footpath floor panel 17, a footing curved facade panel 18 and a wall panel curved facade panels 19. Such exterior panels may be used to provide an exterior surface to the building structure or a section of the building structure.

It should also be noted that the type of foundation should not be considered to be limited to a pier type of foundation, other types of foundation structures used in the building industry may also be utilised.

In a specific example, the modular building elements are manufactured from concrete. The modular building elements, for example, wall panels, floor panels, socket beams and exterior panels, may be manufactured by pouring wet concrete into casting moulds. This procedure may be carried out either on-site at the building location, or at a remote location, for example a factory, and then transported to the building location.

FIG. 1(*b*) illustrates a configuration unit, the configuration unit comprised of a wall panel, a floor panel and a socket beam. The socket beam of a configuration unit may be any of a variety of sizes. If a configuration unit is repeated in a side-by-side manner adjacent socket beams will abut each other and additional wall and floor panels may be used to complete a structure. FIG. 1(*c*) illustrates views of configuration units with cut-out regions to show how modular elements can be connected.

Figure 2:
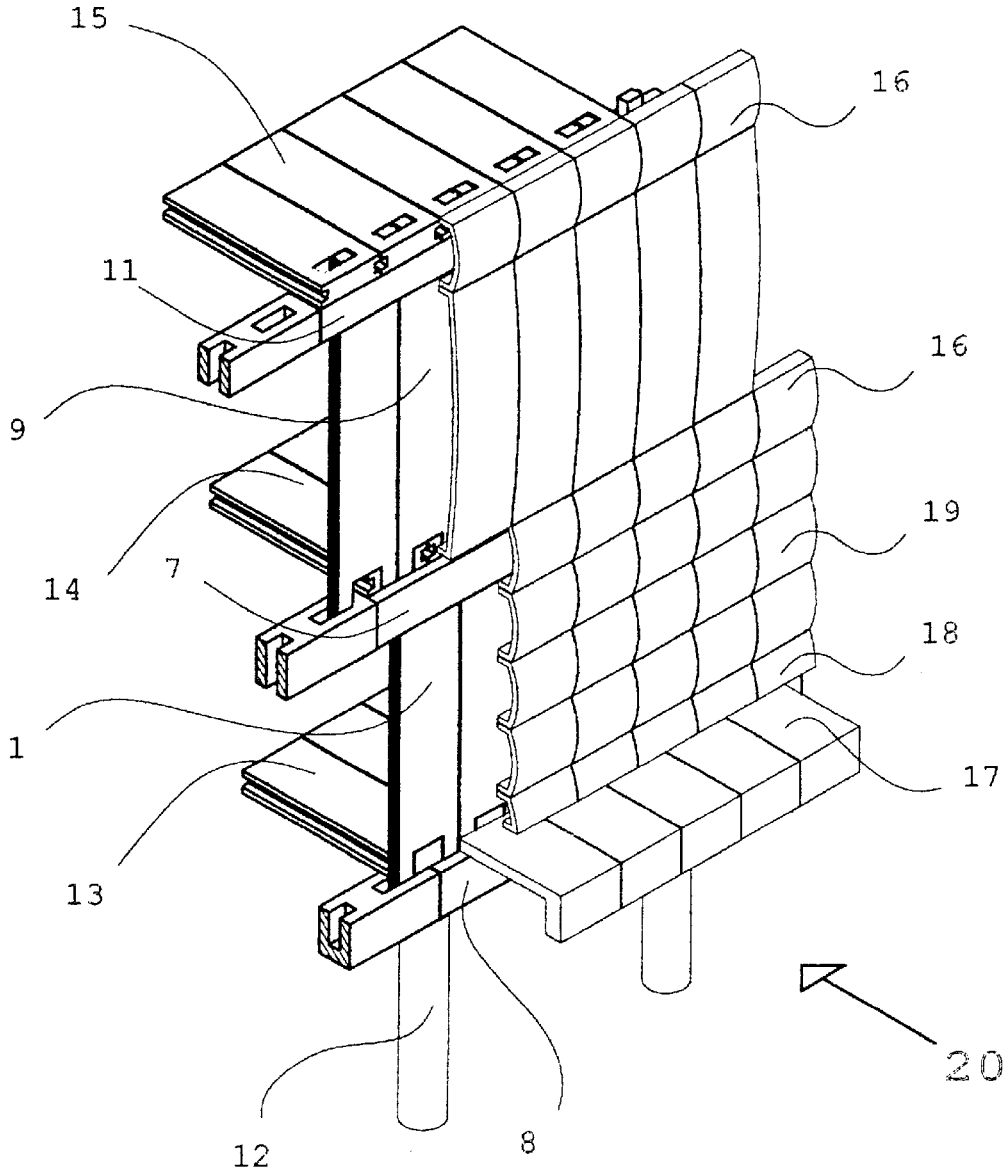
FIG. 2 illustrates a preferred embodiment of the present invention wherein, the figure shows an isometric view of a portion of assembled modular building elements.

FIG. 2 shows similar elements to those shown in FIG. 1 except that FIG. 2 illustrates the modular elements as partially assembled. This figure illustrates part of a building structure 20 which may be extended in horizontal and in vertical extent. The geometry of wall panels, floor panels and socket beams is not limited to the geometries presented in this, or any, of the figures, furthermore, the arrangement of specific types of wall panels, floor panels and socket beams should not be considered limited to that which is presented in the figures. Numerous alternate configurations may be envisaged, and readily assembled.

Figure 3:
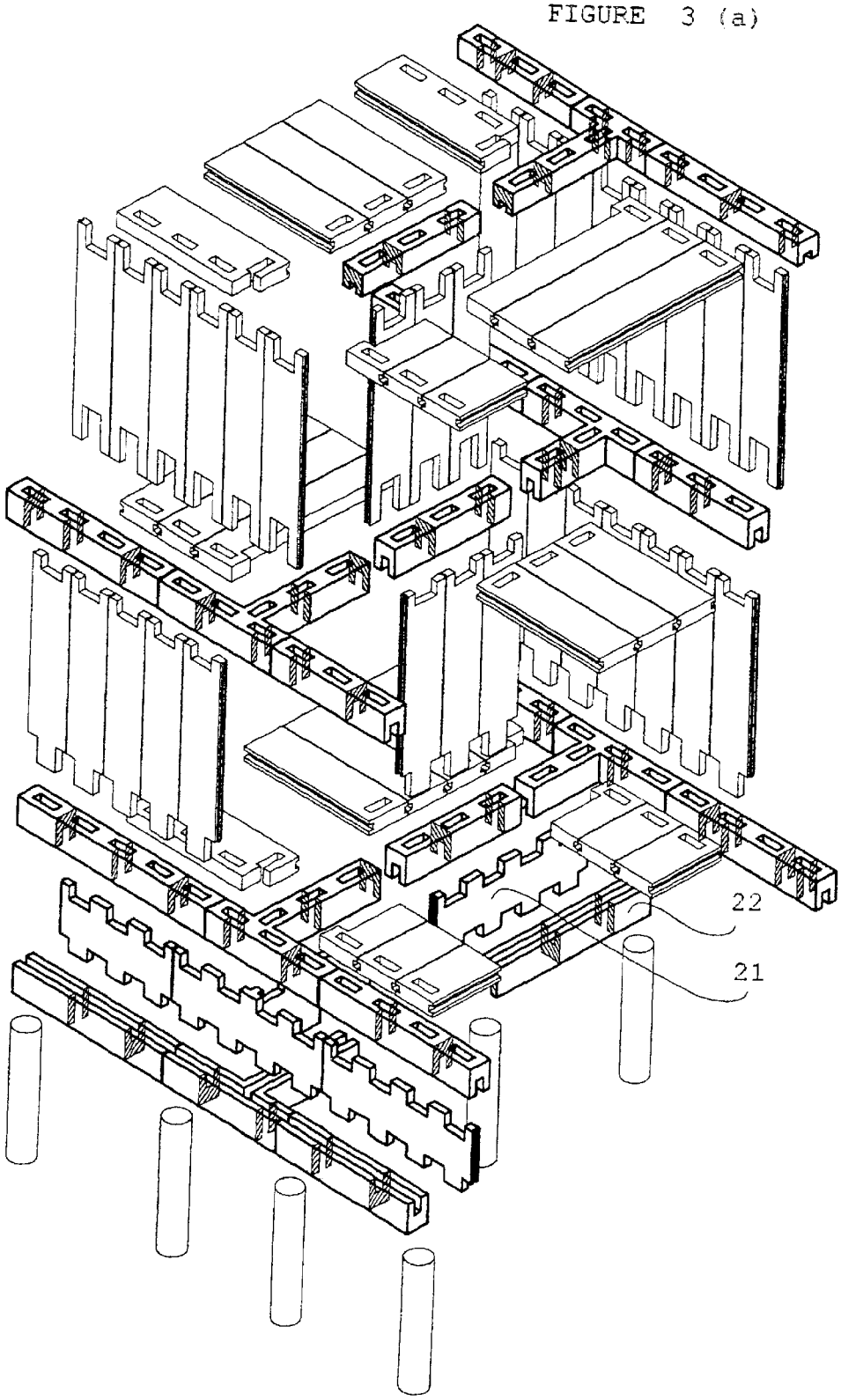
FIG. 3(*a*) illustrates a preferred embodiment of the present invention wherein, the figure shows an isometric view of disjoined modular building elements having a foundation wall panel variation.
Figure 3:
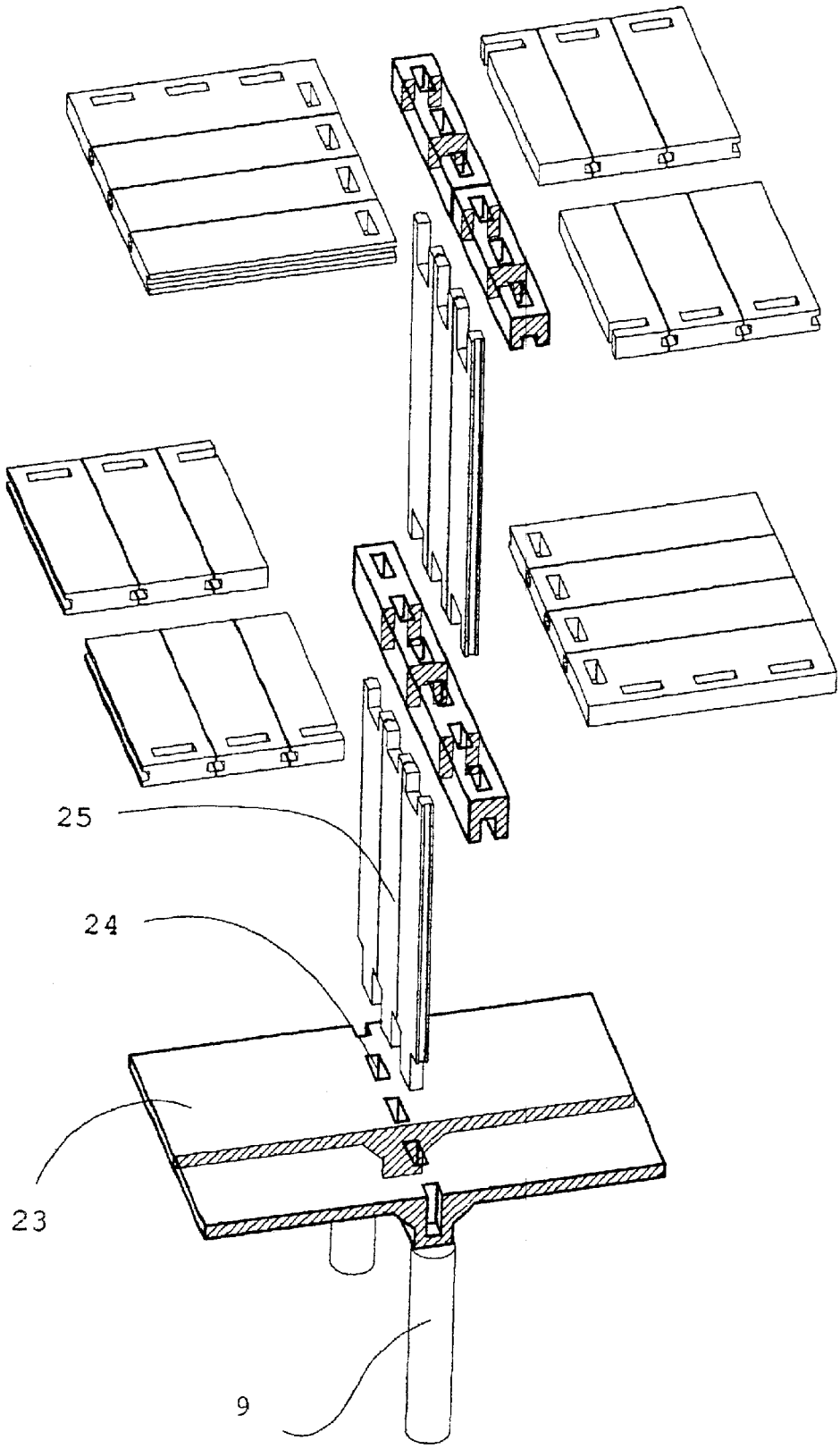

Illustrated in FIG. 3(*a*) is a variation in the configurations of the building structure. In this embodiment of the invention a foundation first modular building element is supported by a type of socket beam, the socket beam described as a foundation support socket beam. The foundation first modular building element is represented in this figure as a foundation wall panel 21 which interconnects with at least one foundation support socket beam 22, the socket beam 22 need not necessarily be of the same type as previously mentioned socket beams, but may be an alternative type of socket beam specially constructed to associate with the foundation wall panel, for example, if it is desired that the socket beam 22 withstand a substantial force. FIG. 3(*a*) illustrates how a building structure may be constructed using this variation of modular building element or modular building elements.

FIG. 3(*b*) shows a further embodiment of the present invention. In the figure a foundation second modular building element associates with the building structure foundation 12. In this embodiment the foundation second modular building element is a foundation ground floor panel 23 which contains slots 24, the slots capable of receiving protrusions from various types of wall panels, for example, the wall panels 25.

FIG. 4(*a*) illustrates various types of wall panels. The different geometries of wall panels may, naturally, be also used as floor panels. The choice of wall panel or floor-panel geometry will depend upon the specific application or location in the building structure.

Also, the present invention is not limited to these geometries only, many variations on these geometries may be used.

FIG. 4(*b*) illustrates various types of floor panels. The floor panels as shown are indeterminate in length as indicated by the jagged break in the illustrated floor panels. Similarly to wall panels, the present invention is not limited to these geometries only, many variations on these geometries may be used.

Figure 5:
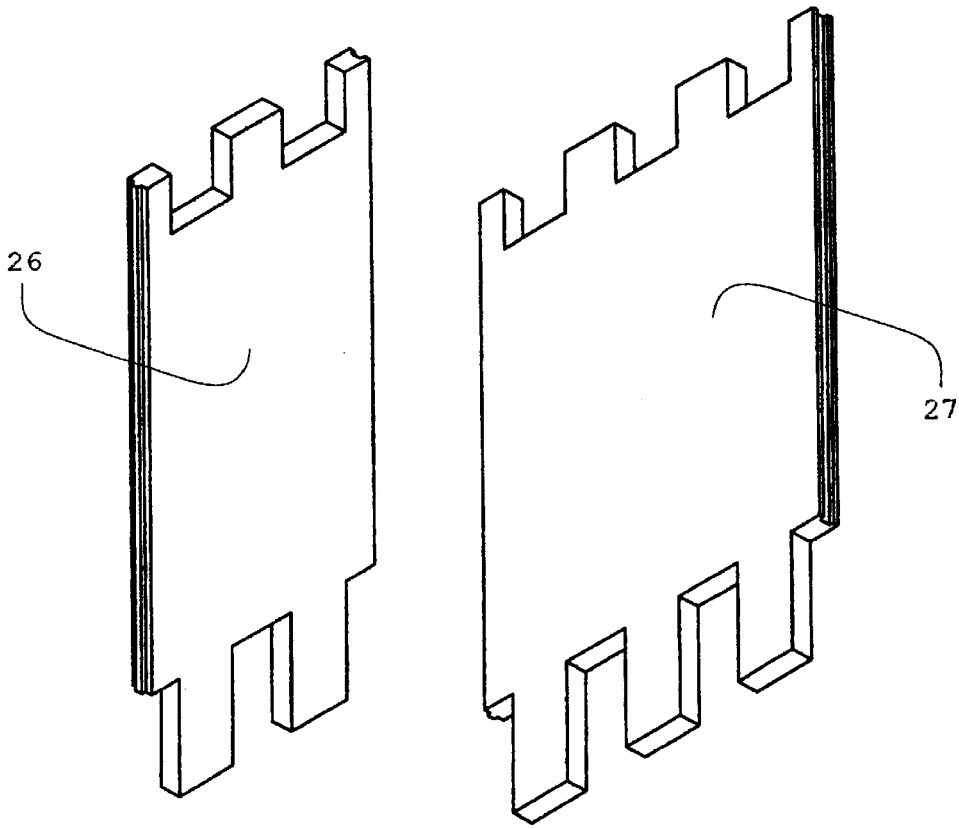
FIG. 5 illustrates a preferred embodiment of the present invention wherein, the figure shows an isometric view of a further selection of wall panels.

Presented in FIG. 5 are further examples of panel geometries which may be utilised as either wall panels or floor panels. In FIG. 5(*a*) the modular building element 26 is of a larger width than previously disclosed, also the element contains multiple protrusions at both ends. The configuration of the protrusions may be significantly varied, what is required is that if protrusions are present then they should be capable of associating with socket beams of a corresponding geometry. FIG. 5(*b*) shows a further example of a modular building element 27 wherein the dimensions of the element have been further extended to illustrate the variety of geometries of elements which may be utilised to work the present invention.

Figure 6:
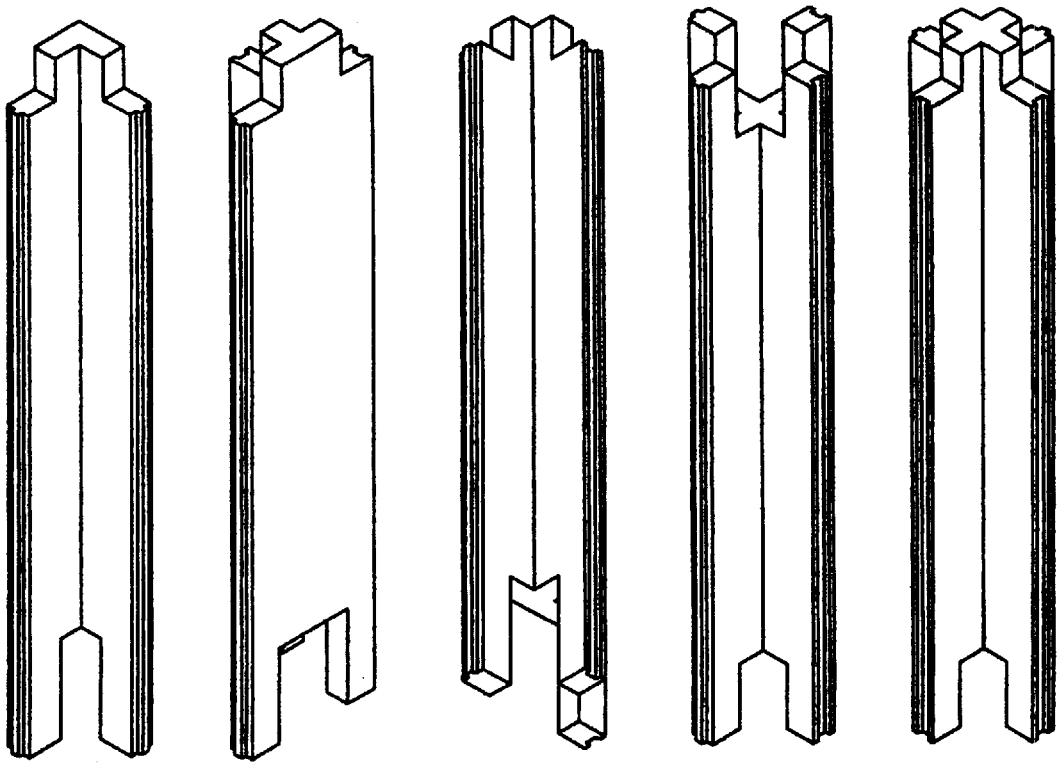
FIG. 6 illustrates a preferred embodiment of the present invention wherein, the figure shows an isometric view of a selection of wall panel corner types.
Figure 6:
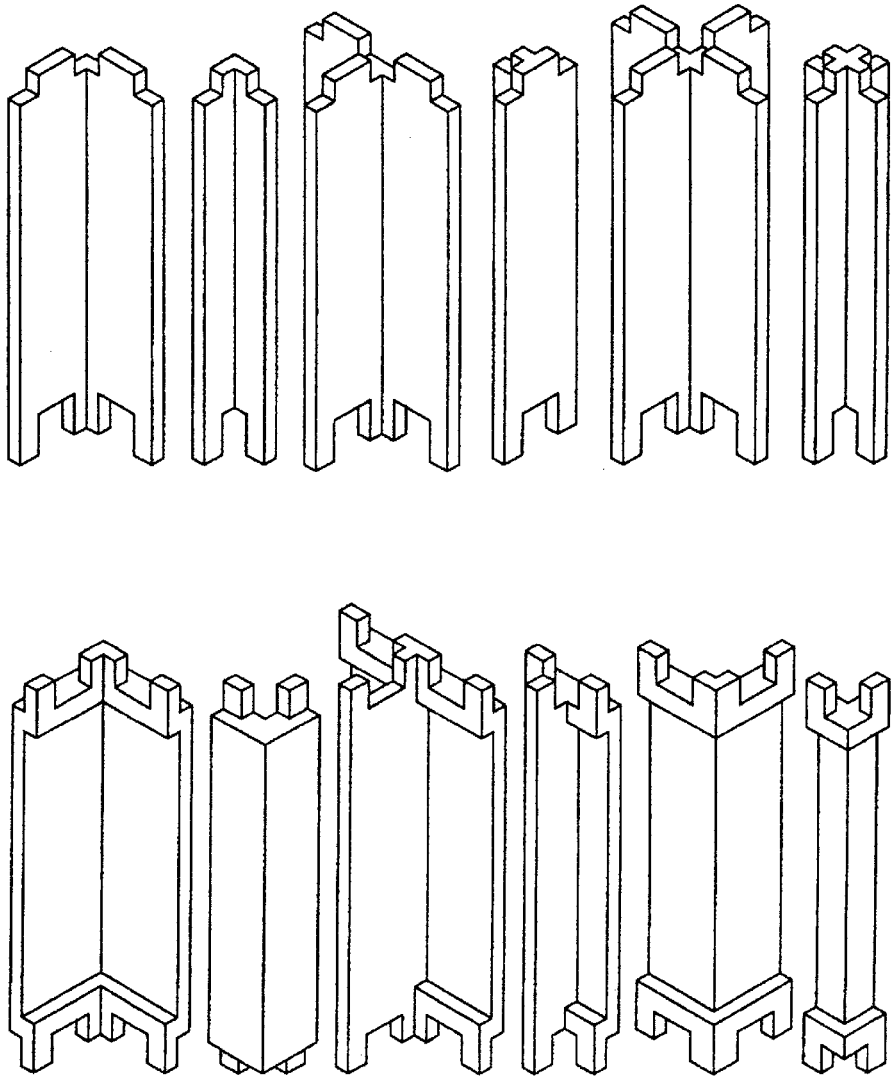

FIG. 6 illustrates a further type of modular building element which may be used as a corner modular building element. Specifically, the corner building elements shown in FIG. 6 may be used as corner wall panels or corner floor panels so as to create rooms or sections within a building structure. FIG. 6(*a*) shows a L-type corner wall panel, FIG. 6(*b*) shows a T-type corner wall panel, FIG. 6(*c*) shows an alternative view of a T-type corner wall panel, FIG. 6(*d*) shows a X-type corner wall panel and FIG. 6(*e*) shows an alternative view of a X-type corner wall panel. It should be noted, as is the case for all herein mentioned wall and floor panel types, that the means of association of adjacent panels is not limited to that shown in the figures.

Figure 7:
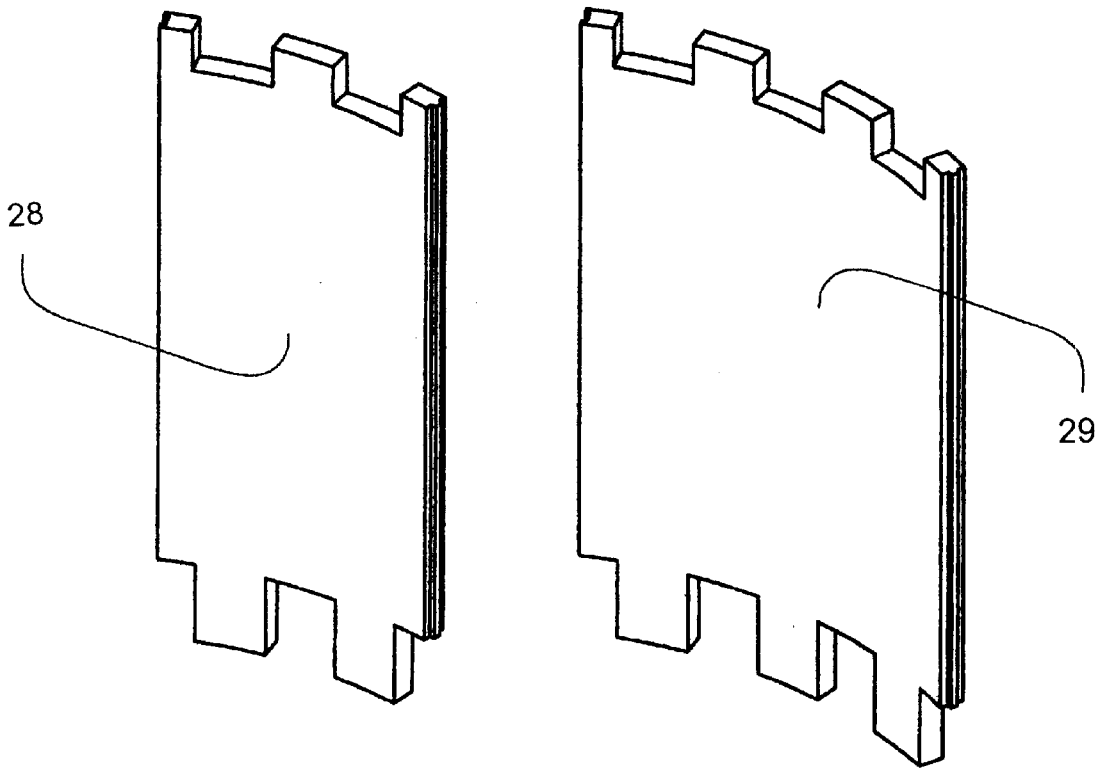
FIG. 7 illustrates a preferred embodiment of the present invention wherein, the figure shows an isometric view of a further selection of wall panel types.
Figure 8:
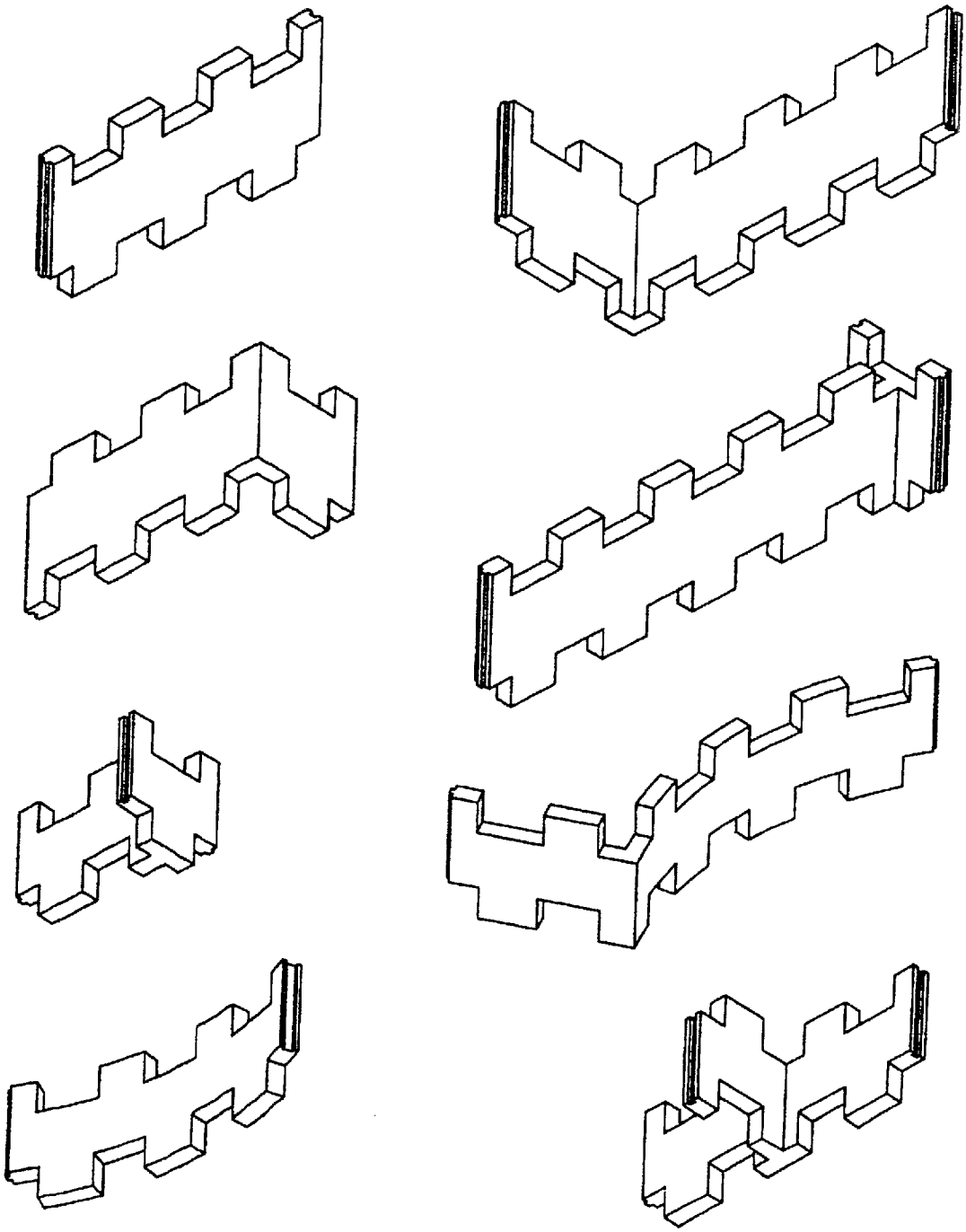
FIG. 8 illustrates a preferred embodiment of the present invention wherein, the figure shows an isometric view of a selection of foundation wall panels.
Figure 9:
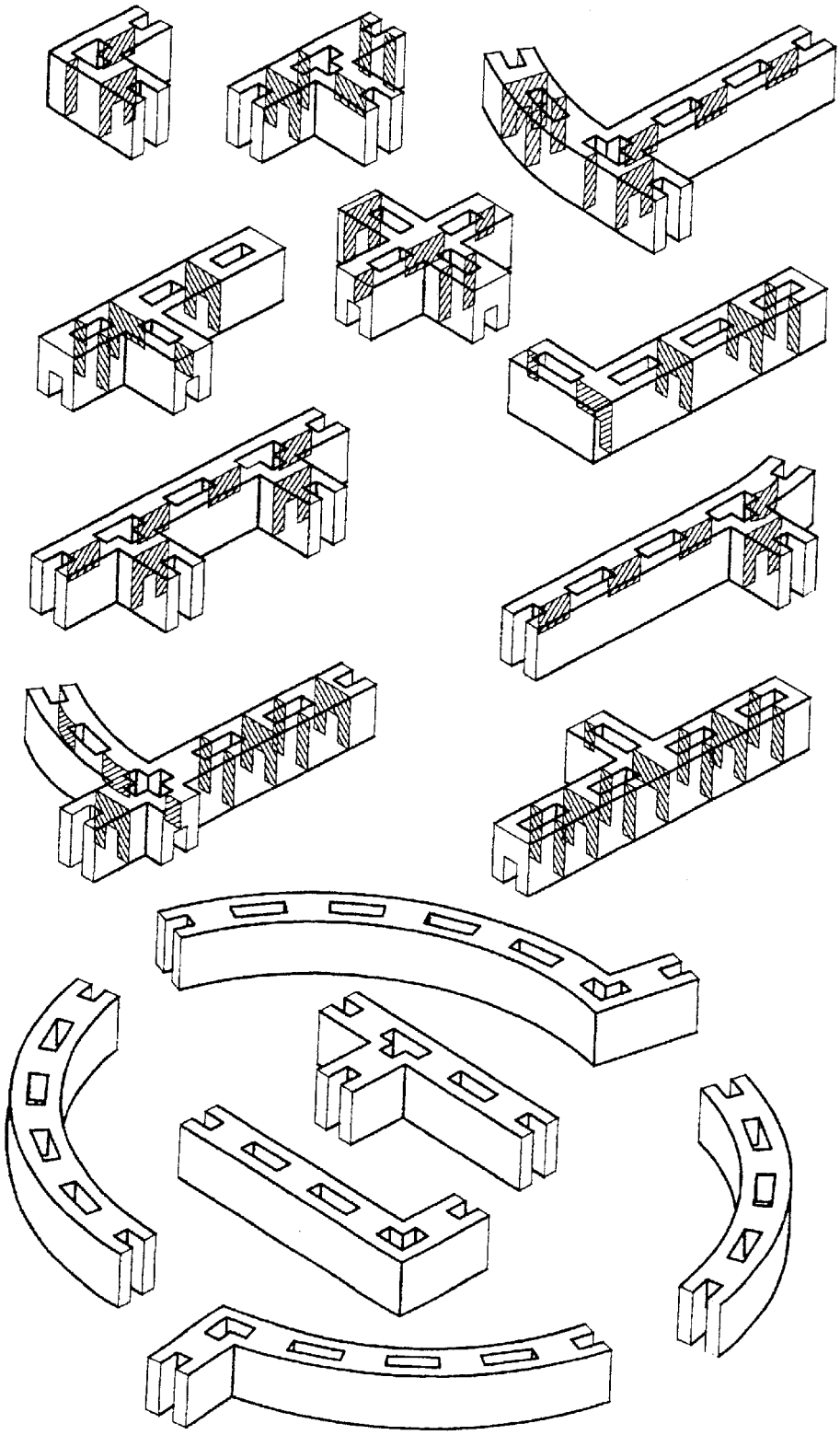
FIG. 9 illustrates a preferred embodiment of the present invention wherein, the figure shows an isometric view of a selection of socket beam variations.
Figure 9:
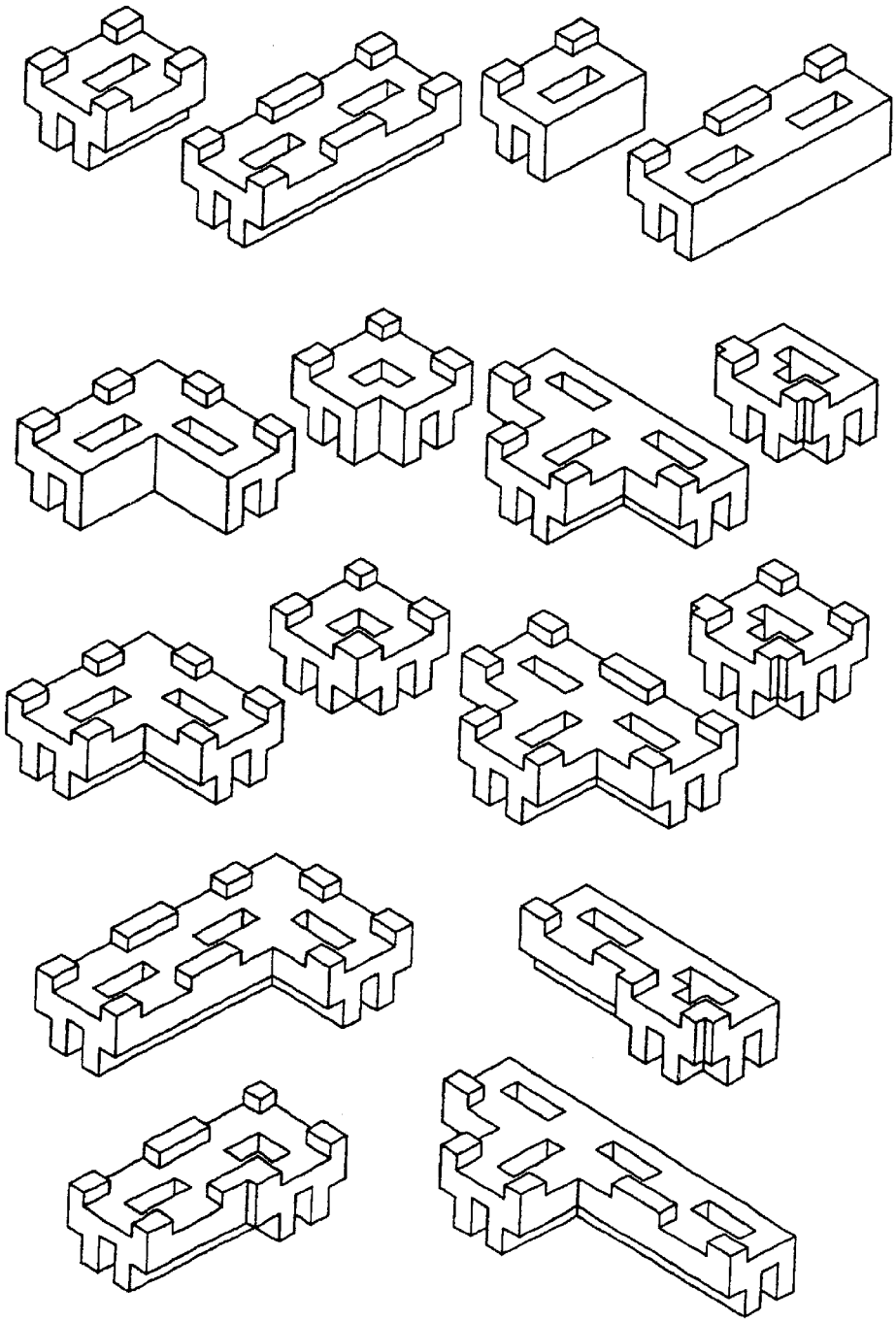

FIG. 7 shows further examples of wall panels in that the wall panels 28 and 29 have a curved surface. The curvature of the surface may be significantly varied depending upon the geometry of building structure, or part of building structure, required. Shown in FIG. 8 are examples of geometries which may be employed as foundation wall panels. Furthermore, FIG. 9 illustrates a variety of socket beams showing the wide range of geometries which may be employed as socket beams. FIGS. 9(*a*) to 9(*c*) illustrate a variety of toy socket beams showing the wide range of geometries which may be employed as toy socket beams for a toy structure.

Figure 10:
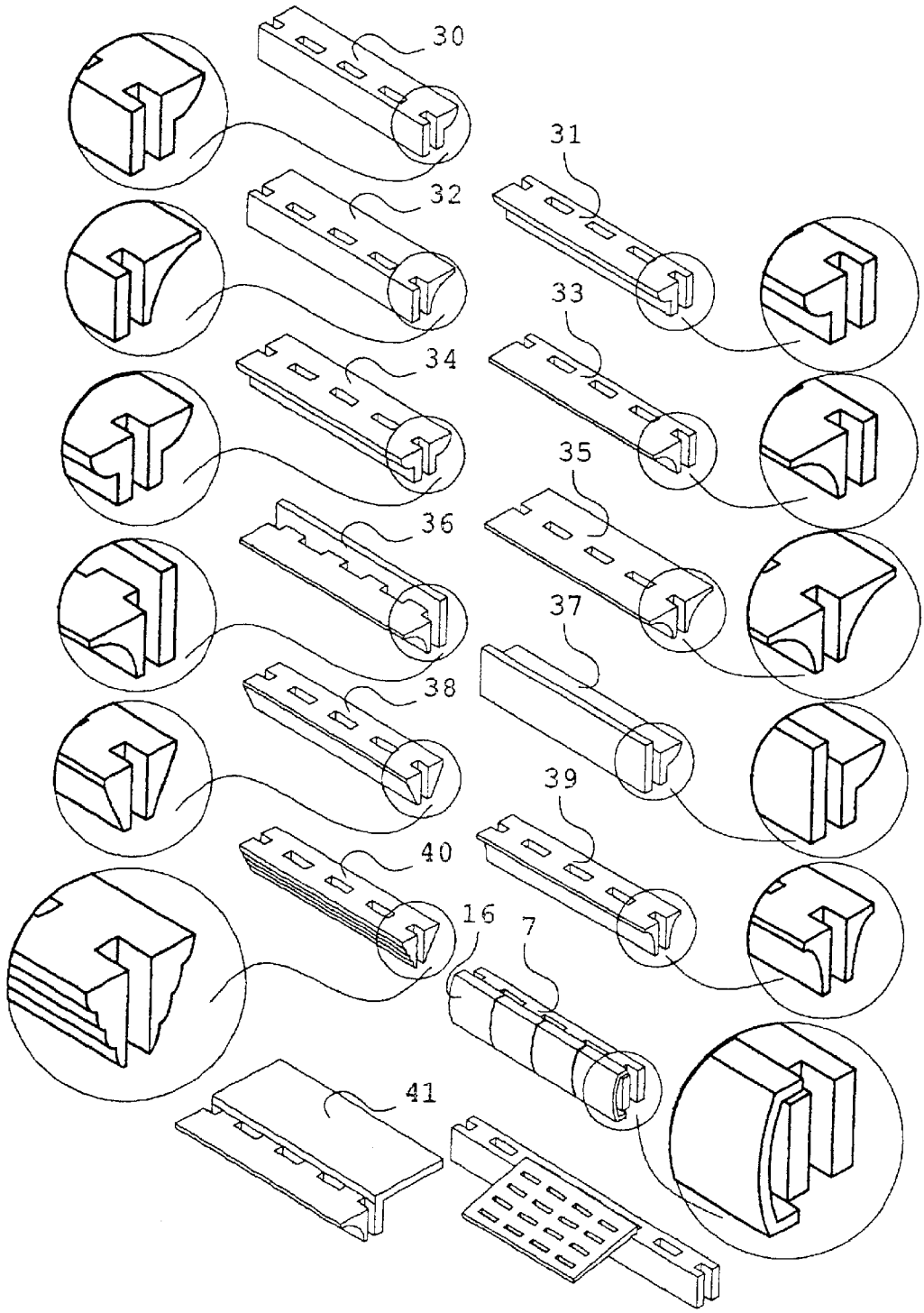
FIG. 10 illustrates a preferred embodiment of the present invention wherein, the figure shows an isometric view of a further selection of socket beam variations.
Figure 11:
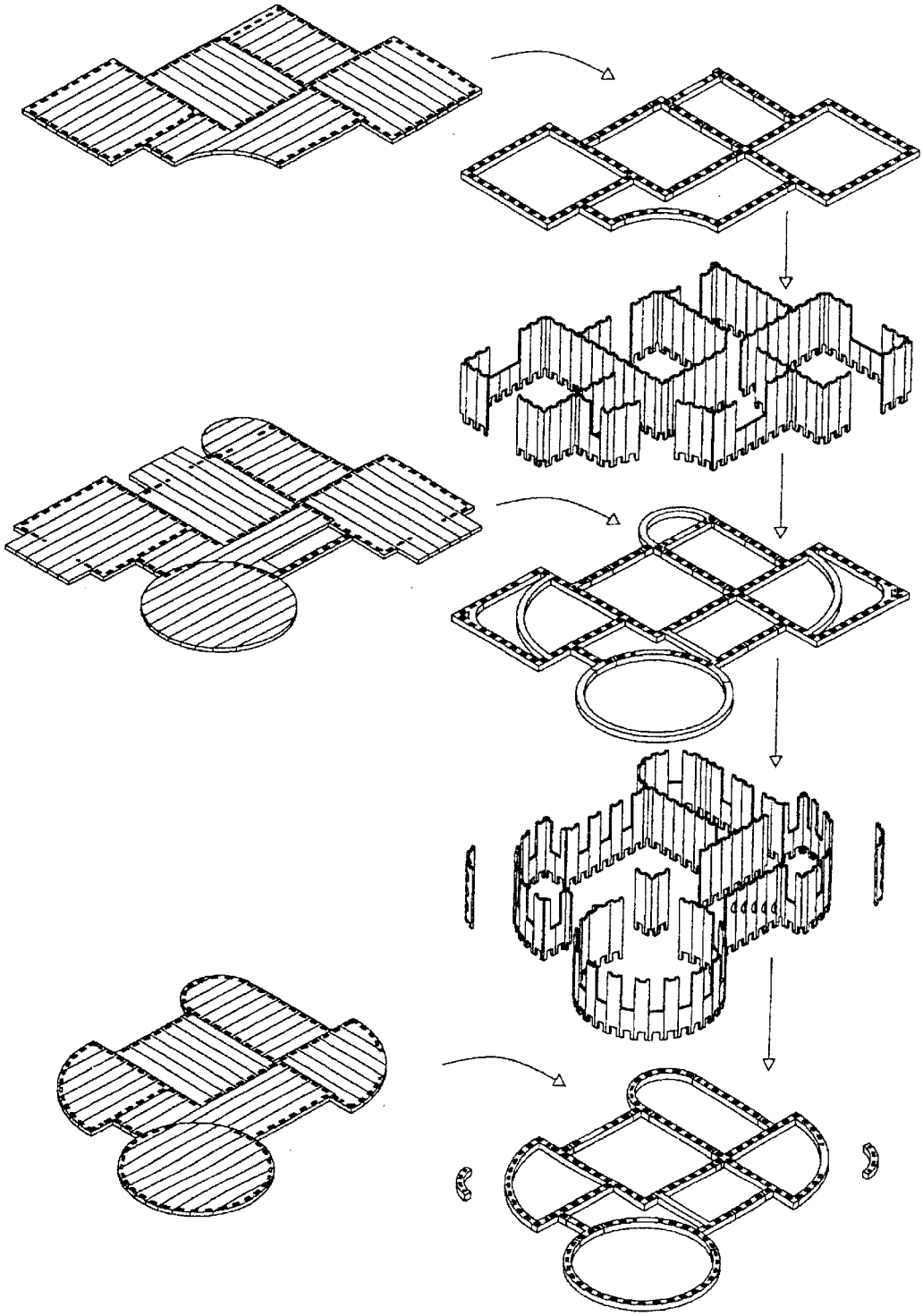
FIG. 11 illustrates an isometric view of an example building structure, the figure shows a two-storey house in disjoined fashion in grouped modular building elements.
Figure 12:
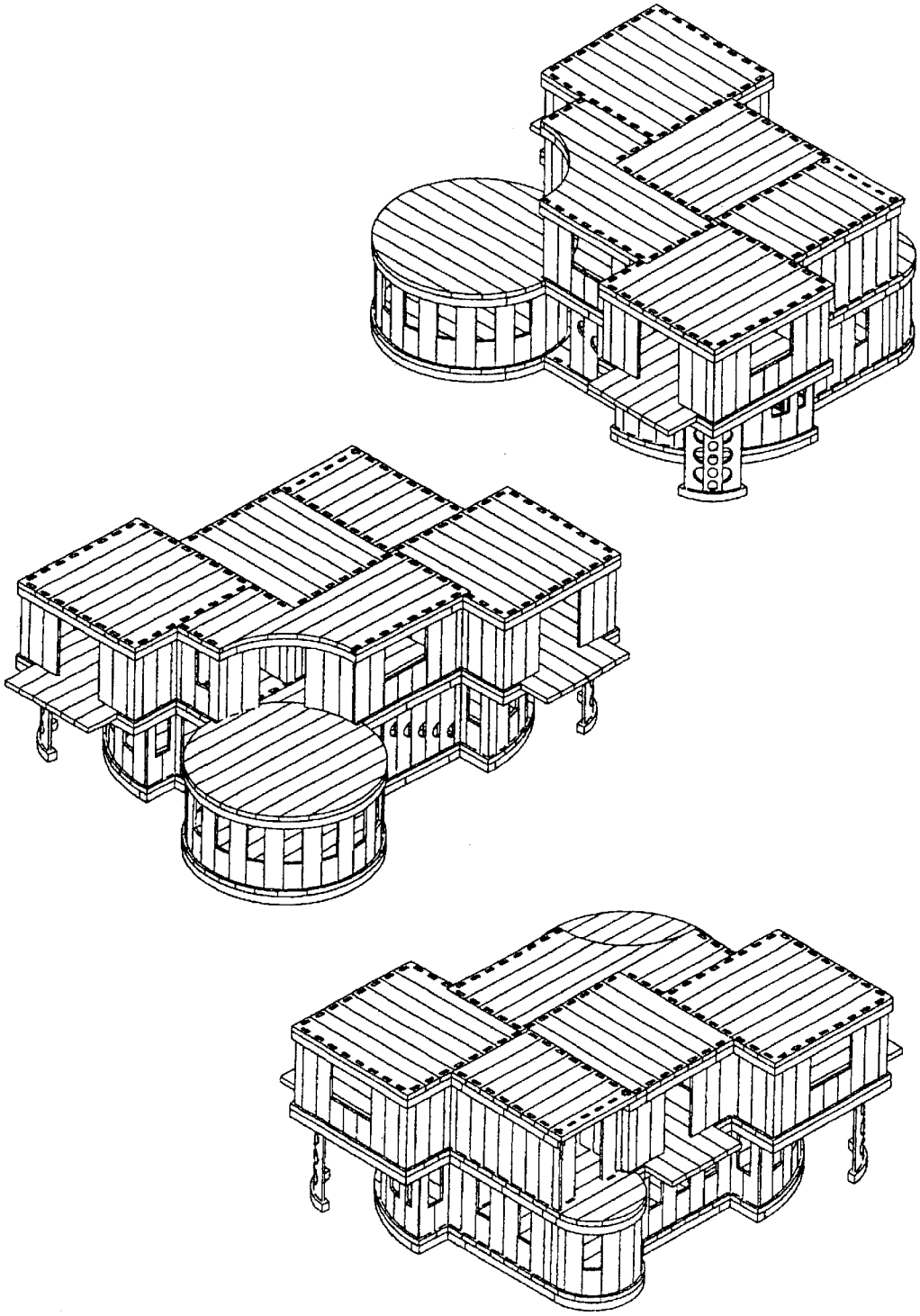
FIG. 12 illustrates three isometric views of an example building structure, the figure shows a two-storey house in assembled fashion.

FIG. 10 illustrates various types of socket beams which may be used for the exterior walls of a building structure. The various socket beams include alternatives to using the socket beam 7 and the exterior facade panel 16. For example, a lateral portion of a socket beam may be provided with an inclined edge, such as socket beam 38; a concave surface, such as socket beam 32; a stepped surface, such as socket beam 40; a curved surface in combination with a planer surface, such as socket beam 30; or various other curved surfaces of differing extent, such as socket beam 36. Furthermore, socket beams 31, 33, 37 and 41 show examples of socket beams whereby only one side of the socket beam has a curved surface, or that the socket beam is asymmetric. Socket beams 34, 35 and 39 additionally illustrate further examples of socket beam configurations. It should be noted that these socket beams do not illustrate an exhaustive list of all forms of socket beams which may be utilised to form part of a building structure as herein described.

The modular building elements may be formed from reinforced concrete or super light concrete and configured into a building structure without any additional wet or welding joints, fasteners or accessories. There has been provided in accordance with the present invention, a building structure which utilises two basic; components, panels and socket beams whereby certain panels associate rigidly with socket beams.

The building structure hereinbefore described thus provides a structure which is frameless, capable of withstanding a degree of earthquake and durable over many years. Also, a relatively small number of relatively unqualified labourers is required to erect the structure.

Furthermore, the building structure may be modified after it has been erected. Additional building elements may be added to an existing building structure. Also, a building structure utilising the building elements may be dismantled by disjoining the building elements at any given time.

Dimensions of the building elements hereinbefore described can vary substantially. As an indicative non-limiting example only, the wall panel 1 may have the dimensions of height 1000 mm to 5000 mm, width 100 mm to 2000 mm, and thickness of 30 mm to 500 mm. Obviously, these n umbers are provided as an indication only and do not limit the scope of dimensions which may be used.

If building elements are manufactured at the building site then the cost of erecting a building structure may be significantly lowered. Furthermore, relatively simple equipment is all th at is required, for ex ample, a working table and a forklift. The system of manufacture may also be palletised to a id subsequent erection of a building structure by a crane.

In another embodiment of the present invention, the modular building elements may be used as children's play building blocks or a miniature building set for constructing scale models. The dimensions of the modular toy elements may be significantly reduced so that they may be handled by people, specifically children. The modular toy elements, that is the first modular toy element, the second modular toy element and the toy socket beam, may be manufactured from, for example, plastic, synthetic polymeric substance, wood, metal or the like, and may be connected together in the manner hereinbefore described so that various toy structures may be built by a child. Similar to the discussion for a real building structure, the modular toy elements can be used to define a toy configuration unit which can be repeated to form a toy structure. As a toy structure does not require consideration of real forces associated with load bearing and mechanical stresses the modular toy elements can be built from a wider variety of shapes.

Thus, there has been provided in accordance with the present invention, a building structure using modular building elements which satisfies the advantages set forth above.

Although the preferred embodiment has been described in detail, it should be understood that various changes, substitutions, and alterations can be made herein by one of ordinary skill in the art without departing from the spirit or scope of the present invention.

What is claimed is:

1. A building structure formed from modular building elements, wherein the building structure includes:

first modular building elements having prefabricated protrusions of a same material as a remainder of said first modular building elements, said prefabricated protrusions for interconnection with at least one socket beam; and second modular building elements; and socket beams each having a substantially upside down U-shaped profile, at least one hole and a slot or recess for receiving respective ones of said prefabricated protrusions of said first modular building elements, said at least one hole being laterally centered in said socket beams and said slot or recess being located longitudinally under an upper surface of said respective one of said socket beams, whereby a each of said socket beams forms an interconnection with at least one of said first modular building elements and at least one of said second modular building elements, such that, a one of said socket beams, at least one of said first modular building elements and at least one of said second modular building elements form a configuration unit, the configuration unit for engaging or abutting adjacent configuration units in a side by side fashion such that adjacent ones of the second modular building elements define a substantially planar surface, and whereby each of said first modular building elements abuts adjacent ones of said first modular building elements, each of said second modular building elements abuts adjacent ones of said second modular building elements and each of said socket beams abuts adjacent ones of said socket beams.

2. A building structure as claimed in claim 1, wherein a within said configuration unit, said at least one second modular building element has at least one edge supported by a portion of said one of said socket beams.

3. A building structure as claimed in claim 1, wherein the configuration unit engages or abuts other adjacent configuration units in a one atop the other fashion to provide a multi-storey building structure being finished at a top thereof by a top one of said socket beams and a top one of said second modular building elements included in one of said configuration units, said top one of said second modular building elements being substantially identical to others of said second modular building elements and said top one of said socket beams being substantially identical to others of said socket beams.

4. A building structure as claimed in claim 1, wherein a foundation structure is provided and at least one of the first modular building elements, second modular building elements and socket beams associates with the foundation structure.

5. A building structure as claimed in claim 4, wherein a foundation support socket beam associates with the foundation structure, the foundation support socket beam being interconnected with a foundation first modular building element, and at least one of said socket beams being interconnected with the foundation first modular building element.

6. A building structure as claimed in claim 4, wherein a foundation second modular building element associates with the foundation structure, the foundation second modular building element receiving at least one first modular building element.

7. A building structure as claimed in claim 1, wherein said a first modular building elements are wall panels and a said second modular building elements are floor panels or ceiling panels.

8. A building structure as claimed in claim 1, wherein at least one edge of a one of said first modular building elements has an off-center one of said protrusions, and an adjacent one of said first modular building elements also has an off-center one of said protrusions on at least one edge so that the off-center protrusions abut and form a combined protrusion, said combined protrusion being received in one of said at least one hole and said slot or recess in one of said socket beams.

9. A building structure as claimed in claim 1, wherein at least one edge of a one of said second modular building elements has at least one of said protrusions whereby an angled joint is formed by the at least one of said protrusions of the one of said second modular building elements and a one of said protrusions of one of said first modular building elements, the one of said protrusions of the one of said second modular building elements being intermediate the one of said first modular building elements and a respective one of the socket beams.

10. A building structure as claimed in claim 9, wherein an angle of the angled joint is substantially perpendicular.

11. A building structure as claimed in claim 1, wherein at least one of the first modular building elements is a corner modular building element whereby the corner modular building element has an L-type, T-type or X-type geometry.

12. A building structure as claimed in claim 1, wherein any at least one of the first modular building elements and at least one of the socket beams is curved.

13. A building structure as claimed in claim 1, wherein one edge of each of the first modular building elements or each of the second modular building elements has a flange, and an opposing edge has a channel or recess.

14. A building structure as claimed in claim 13, wherein, each flange of the first or second modular building elements associates with the channel or recess of an adjacent one of the first or second modular building elements.

15. A building structure as claimed in claim 1, wherein each edge of each of the first modular building elements or each of the second modular building elements has an edge channel or edge recess, whereby a periphery region of the edge channel or edge recess of one of said modular building elements abuts a periphery region of the edge channel or edge recess of an adjacent one of the modular building elements.

16. A building structure as claimed in claim 1, wherein exterior modular building elements are affixed to selected ones of the socket beams, first modular building elements and second modular building elements.

17. A building structure as claimed in claim 1, wherein thin, maximum 5 mm connection gaps between the first modular building elements, the second modular building elements and the socket beams are filled with a sealant.

18. A building structure as claimed in claim 1, wherein the first modular building elements, second modular building elements and socket beams are manufactured from any one of concrete, reinforced concrete, super light concrete, composite materials, fibre concrete, and any combination thereof.

19. A building structure as claimed in claims 1, wherein the building structure is frameless.

20. A building structure as claimed claim 1, wherein the first modular building elements, second modular building elements and socket beams are detachable from each other.

21. A building structure as claimed in claim 1, wherein each said at least one hole is provided on an upper surface of a respective one of the socket beams and each said slot or recess is laterally centered on a lower surface of a respective one of the socket beams, each said at least one hole for receiving one of said protrusions from at least one of said first modular building elements, and each said slot or recess receiving one of said protrusions from a lower, adjacent one of said first modular building elements.

22. A toy structure formed from toy building elements, wherein the toy structure includes:

first modular toy elements having protrusions for interconnection with at least one toy socket beam; and second modular toy elements; and toy socket beams each having a substantially upside down U-shaped profile, at least one hole and longitudinal slot or recess for receiving respective ones of said protrusions of said first modular toy elements, the toy socket beams having a different geometry than the first modular toy elements and the second modular toy elements, whereby each of the toy socket beams forms an interconnection with at least one of said first modular toy elements and at least one of said second modular toy elements; such that, one of said toy socket beams, at least one of said first modular toy elements and at least one of said second modular toy elements form a configuration unit, the configuration unit for engaging or abutting adjacent configuration units in a side by side fashion such that adjacent ones of the second modular toy elements define a substantially planar surface, and whereby each of said first modular toy elements abuts adjacent ones of said first modular toy elements, each of said second modular toy elements abuts adjacent ones of said second modular toy elements and a each of the toy socket beams abuts adjacent ones of said toy socket beams.

23. A toy structure as claimed in claim 22, wherein the modular toy elements are toy building blocks and are manufactured from plastic, a suitable synthetic polymeric substance, wood, or metal.

24. A toy structure as claimed in claim 22, wherein the toy structure is a miniature building.

25. A system of erecting a building structure including the steps of:

forming a building structure foundation; and using the building structure foundation to support a first layer of socket beams positioned at desired locations; and using the first layer of socket beams to vertically support a first level of second modular building elements; and using the first layer of socket beams to support a first level of first modular building elements, said socket beams receiving protrusions from said first modular building elements as interconnection means; and using holes of the first layer of socket beams and the protrusions of the first level of first modular building elements to laterally hold the first level of second modular building elements, and whereby the first layer of socket beams, the first level of second modular building elements and the first level of first modular building elements form a typical configuration level of said building structure, the typical configuration level of said building structure being repeatable one atop the other to provide a multi-storey building structure, said multi-storey building structure being finished at the top by an extra layer of said socket beams and an extra level of said second modular building elements.

26. A system of erecting a building structure as claimed in claim 23, wherein the first modular building elements, second modular building elements and socket beams are manufactured on-site at a location of the building structure.

* * * * *